US005756274A

United States Patent [19]

Matsuda et al.

[11] Patent Number: 5,756,274

[45] Date of Patent: May 26, 1998

[54] SILVER HALIDE COLOR PHOTOGRAPHIC MATERIAL AND METHOD FOR FORMING IMAGES

[75] Inventors: Naoto Matsuda; Takayuki Ito; Naoki Saito, all of Kanagawa, Japan

[73] Assignee: Fuji Photo Film Co., Ltd., Kanagawa, Japan

[21] Appl. No.: 685,829

[22] Filed: Jul. 25, 1996

[30] Foreign Application Priority Data

Jul. 27, 1995 [JP] Japan ..... 7-210209

[51] Int. Cl.[6] ..... G03C 1/46

[52] U.S. Cl. ..... 430/558; 430/384; 430/385; 430/551

[58] Field of Search ..... 430/558, 551

[56] References Cited

U.S. PATENT DOCUMENTS

| | | | |
|---|---|---|---|
| 4,994,351 | 2/1991 | Haga et al. | 430/379 |
| 5,434,034 | 7/1995 | Asami | 430/558 |
| 5,578,441 | 11/1996 | Nagaoka et al. | 430/558 |

FOREIGN PATENT DOCUMENTS 6-83002 3/1994 Japan .

*Primary Examiner*—Hoa Van Le
*Attorney, Agent, or Firm*—Birch, Stewart, Kolasch & Birch, LLP

[57] ABSTRACT

A silver halide color photographic material is described, comprising a support having provided thereon at least one blue-sensitive silver halide emulsion layer, at least one green-sensitive silver halide emulsion layer, and at least on red-sensitive silver halide emulsion layer, wherein at least one layer of the at least one red-sensitive silver halide emulsion layer contains at least one of the cyan couplers represented by formula (1), and at least one layer contains at least one compound selected from the compounds represented by the following formula (2) and the compounds which react with the oxidized product of an aromatic primary amine color developing agent but substantially do not form color images:

(1)

(2)

wherein the variables are defined herein.

16 Claims, No Drawings

SILVER HALIDE COLOR PHOTOGRAPHIC MATERIAL AND METHOD FOR FORMING IMAGES

FIELD OF THE INVENTION

The present invention relates to a silver halide color photographic material and, in particular, to a silver halide color photographic material which is improved in color reproducibility and picture quality.

BACKGROUND OF THE INVENTION

In a silver halide color photographic material in which images are formed by a coupling reaction of couplers with the oxidized product of an aromatic primary amine color developing agent, phenol based compounds or naphthol based compounds are generally known as couplers used for forming cyan images. However, the dyes formed by these couplers have unnecessary side absorption and the improvement in color reproduction has been desired.

As a means for solving this problem, pyrroloazole couplers have been proposed in U.S. Pat. Nos. 5,256,526 and 5,270,153. These couplers have are excellent in hue and coupling activity, and further have a characteristic that the molar absorption coefficient (hereinafter referred to as $\epsilon$) is large compared with phenol or naphthol based couplers.

In a silver halide color photographic material, in general, when a coupler having high $\epsilon$ or good in equivalence (this means coloring is possible with a smaller amount of silver, for example, a 2-equivalent coupler is better than a 4-equivalent coupler in equivalence) is used, the same color density can be obtained with a smaller amount of silver halide emulsion. Accordingly, this is advantageous in saving silver halide emulsion when designing a photographic material. However, a mere decrease of the amount of an emulsion leads to the deterioration of graininess. Therefore, the decrease is is not desired, in particular, in a photographic material for photographing (for example, a color negative film, a color reversal film). In such a case, a method which lowers silver-dye conversion rate (or dye yield curve, disclosed, for example, in *Journal of Photographic Science*, Vol. 41, pages 161 to 171 (1993)) by using combinations of competitive compounds without largely reducing the amount of an emulsion is sometimes adopted.

Competitive compounds are compounds which react with the oxidized product of an aromatic primary amine color developing agent competing with image-forming couplers but substantially do not form color images. These compounds can be selected from the same compounds as used in an interlayer of a color photographic material as color mixing preventives, for example, hydroquinones, hydrazines and non-color-forming couplers (so-called wash-out couplers and colorless couplers) which react with the oxidized product of an aromatic primary amine color developing agent but do not participate in image formation are known.

Of these, when hydroquinones are added in the same layer, as competitive compounds, with pyrroloazole couplers, scavenging activity of the oxidized product of a color developing agent is not sufficient and when used in a large amount, deteriorations of raw stock storability and light fastness of images are generated.

On the contrary, hydrazines or wash-out couplers are preferred compared with hydroquinones as they do not deteriorate raw stock storability and light fastness of images. However, as a result of the examination by the present inventors, when hydrazines are added in the same light-sensitive emulsion layer in which the pyrroloazole couplers are contained, as the sensitivity in the part of the minimum density changes, sufficient improvement in graininess could not be obtained.

A combined use of pyrroloazole couplers with wash-out couplers for the purpose of mainly suppressing color fog (color fog means the rising of minimum density) of a color printing material is disclosed in JP-A-6-83002 (the term "JP-A" as used herein means an "unexamined published Japanese patent application"), but the prevention of color fog makes use of toe cut of the above dye yield curve, which does not contribute to the improvement of graininess. Accordingly, a practical method which uses pyrroloazole couplers to improve color reproducibility and picture quality (in particular, graininess) has not yet been established and the improvement of such a method has been desired.

SUMMARY OF THE INVENTION

Accordingly, an object of the present invention is to provide a silver halide color photographic material which contains a pyrroloazole based cyan coupler excellent in hues, and is improved in color reproducibility, graininess and raw stock storability of the photographic material.

As a result of eager endeavors of the present inventors, the above object of the present invention has been attained by the following means. That is, (1) a silver halide color photographic material comprising a support having provided thereon at least one blue-sensitive silver halide emulsion layer, at least one green-sensitive silver halide emulsion layer, and at least one red-sensitive silver halide emulsion layer, wherein at least one layer of said at least one red-sensitive silver halide emulsion layer contains at least one of the cyan couplers represented by the following formula (1), and at least one layer contains at least one compound selected from the compounds represented by the following formula (2) and the compounds which react with the oxidized product of an aromatic primary amine color developing agent but substantially do not form color images:

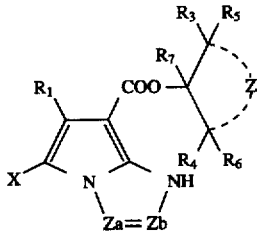

(1)

wherein Za represents —C($R_2$)= or —N=, when Za represents —N=, Zb represents —C($R_2$)= and when Za represents —C($R_2$)=, Zb represents —N=; $R_1$ represents an electron attractive group having a Hammett's substituent constant $\sigma p$ value of from 0.20 to 1.0; $R_2$ represents a substituent; X represents a hydrogen atom or a group separated upon coupling reaction with the oxidized product of an aromatic primary amine color developing agent; $R_3$ and $R_4$ each represents an aliphatic group; $R_5$, $R_6$ and $R_7$ each represents a hydrogen atom or an aliphatic group; and Z represents a non-metal atomic group necessary to form a saturated or unsaturated ring;

(2)

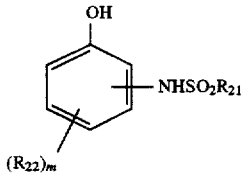

wherein $R_{21}$ represents an alkyl group or an aryl group which may be substituted; the substitution position of $NHSO_2R_{21}$ is the 2-position or 4-position of OH; $R_{22}$ represents a substituent; m represents 0 or an integer of 1, 2, 3 or 4, and when m is 2 or more, the plurality of $R_{22}$'s may be the same or different, they may be bonded with each other to form a saturated or unsaturated ring, or they may be bonded to polymer chain.

(2) A silver halide color photographic material comprising a support having provided thereon at least one blue-sensitive silver halide emulsion layer, at least one green-sensitive silver halide emulsion layer, and at least one red-sensitive silver halide emulsion layer, wherein at least one layer of said at least one red-sensitive silver halide emulsion layer comprises a red-sensitive unit layer comprising at least two red-sensitive emulsion layers having different sensitivities, at least one layer of said at least two layers which constitute the red-sensitive unit layer contains at least one of the cyan couplers represented by formula (1), and an interlayer is provided between two red-sensitive emulsion layers in said red-sensitive layer unit so as to contact with the two red-sensitive emulsion layers at the same time.

DETAILED DESCRIPTION OF THE INVENTION

The present invention will be described in detail below. First of all, the cyan coupler represented by formula (1) is described. The coupler represented by formula (1) is specifically represented by the following formula (3) or (4).

(3)

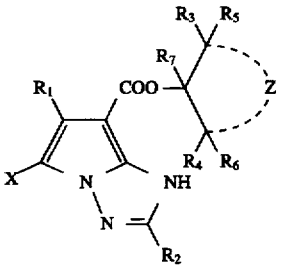

(4)

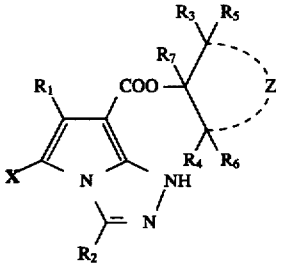

wherein $R_1$, $R_2$, $R_3$, $R_4$, $R_5$, $R_6$, $R_7$ X and Z each has the same meaning as in formula (1).

Couplers represented by formula (3) are particularly preferred in the present invention.

$R_1$ represents an electron attractive group having a Hammett's substituent constant σp value of from 0.20 to 1.0, and preferred examples thereof include a cyano group, an aliphatic oxycarbonyl group (a straight chain or branched chain aliphatic oxycarbonyl group having from 2 to 36 carbon atoms, such as an alkoxycarbonyl group, an aralkyloxycarbonyl group, an alkenyloxycarbonyl group, an alkynyloxycarbonyl group, a cycloalkoxycarbonyl group, or a cycloalkenyloxycarbonyl group, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl, 2,6-di-t-butyl-4-methylcyclohexyloxycarbonyl), a dialkylphosphono group (a dialkylphosphono group having from 2 to 36 carbon atoms, e.g., diethylphosphono, dimethylphosphono), an alkyl- or arylsulfonyl group (an alkyl- or arylsulfonyl group having from 1 to 36 carbon atoms, e.g., methanesulfonyl, butanesulfonyl, benzenesulfonyl, p-toluenesulfonyl), or a fluorinated alkyl group (a fluorinated alkyl group having from 1 to 36 carbon atoms, e.g., trifluoromethyl).

Of these groups, particularly preferred as $R_1$ is a cyano group, an aliphatic oxycarbonyl group, or a fluorinated alkyl group, and a cyano group is most preferred.

$R_3$ and $R_4$ each represents an aliphatic group (for example, a straight chain or branched chain aliphatic group having from 1 to 36 carbon atoms such as an alkyl group, an aralkyl group, an alkenyl group, an alkynyl group, a cycloalkyl group, or a cycloalkenyl group, e.g., methyl, ethyl, propyl, isopropyl, t-butyl, t-amyl, t-octyl, tridecyl, cyclopentyl or cyclohexyl), and particularly preferably a branched alkyl group (e.g., t-butyl, t-amyl, isopropyl).

$R_5$, $R_6$ and $R_7$ each represents a hydrogen atom or an aliphatic group. As the aliphatic group, groups described in $R_3$ and $R_4$ above can be cited. $R_5$, $R_6$ and $R_7$ preferably represent a hydrogen atom.

Z represents a non-metal atomic group necessary to form a 5- to 8-membered ring, the ring may be substituted, or may be a saturated ring, or may contain an unsaturated bond. Preferred non-metal atoms include a nitrogen atom, an oxygen atom, a sulfur atom or a carbon atom, more preferably a carbon atom.

Examples of rings formed by Z include, e.g., a cyclopentane ring, a cyclohexane ring, a cycloheptane ring, a cyclooctane ring, a cyclohexene ring, a piperazine ring, an oxane ring and a thiane ring, and these rings may be substituted with the substituents represented by $R_2$ described later.

A preferred ring formed by Z is a cyclohexane ring which may be substituted, and a particularly preferred ring is a cyclohexane ring substituted with an alkyl group having from 1 to 36 carbon atoms at the 4-position (which may be substituted with a substituent represented by $R_2$ as described below).

$R_2$ represents a substituent, for example, a halogen atom (e.g., fluorine, chlorine, bromine), an aliphatic group (for example, a straight chain or branched chain aliphatic group having from 1 to 36 carbon atoms, such as an alkyl group, an aralkyl group, an alkenyl group, an alkynyl group, a cycloalkyl group, or a cycloalkenyl group, specifically, e.g., methyl, ethyl, propyl, isopropyl, t-butyl, tridecyl, t-amyl, t-octyl, 2-methanesulfonylethyl, 3-(3-pentadecylphenoxypropyl, 3-{4-{2-[4-(4-hydroxyphenylsulfonyl)phenoxy]-dodecanamido}phenyl}propyl, 2-ethoxytridecyl, trifluoromethyl, cyclopentyl, 3-(2,4-di-t-amylphenoxy) propyl), an aryl group (an aryl group having from 6 to 36 carbon atoms, e.g., phenyl, 4-t-butylphenyl, 2,4-di-t-amylphenyl, 4-tetradecanamidophenyl, 2-methoxyphenyl), a heterocyclic group (a heterocyclic group having from 1 to 36 carbon atoms, e.g., 2-furyl, 2-thienyl, 2-pyrimidinyl, 2-benzothiazolyl), a cyano group, a hydroxyl group, a nitro group, a carboxyl group, an amino group, an alkoxyl group (a straight chain, branched chain or cyclic alkoxyl group having from 1 to 36 carbon atoms, e.g., methoxy, ethoxy, butoxy, 2-methoxyethoxy, 2-dodecyloxyethoxy, 2-methanesulfonylethoxy), an aryloxy group (an aryloxy group having from 6 to 36 carbon atoms, e.g., phenoxy, 2-methylphenoxy, 4-t-butylphenoxy, 3-nitrophenoxy, 3-t-butyloxycarbamoylphenoxy, 3-methoxycarbamoyl), an acylamino group (an acylamino group having from 2 to 36 carbon atoms, e.g., acetamido, benzamido, tetradecanamido, 2-(2,4-di-t-amylphenoxy)butanamido, 4-(3-t-butyl-4-hydroxyphenoxy)butanamido, 2-[4-(4-hydroxyphenylsulfonyl)phenoxy]decanamido), an alkylamino group (an alkylamino group having from 1 to 36 carbon atoms, e.g., methylamino, butylamino, dodecylamino, diethylamino, methylbutylamino), an anilino group (an anilino group having from 6 to 36 carbon atoms, e.g., phenylamino, 2-chloroanilino, 2-chloro-5-tetradecanaminoanilino, 2-chloro-5-dodecyloxycarbonylanilino, N-acetylanilino, 2-chloro-5-[2-(3-t-butyl-4-hydroxyphenoxy)dodecanamido]anilino), a ureido group (a ureido group having from 2 to 36 carbon atoms, e.g., phenylureido, methylureido, N,N-dibutylureido), a sulfamoylamino group (a sulfamoylamino group having from 1 to 36 carbon atoms, e.g., N,N-dipropylsulfamoylamino, N-methyl-N-decylsulfamoylamino), an alkylthio group (an alkylthio group having from 1 to 36 carbon atoms, e.g., methylthio, octylthio, tetradecylthio, 2-phenoxyethylthio, 3-phenoxypropylthio, 3-(4-t-butylphenoxy)propylthio), an arylthio group (an arylthio group having from 6 to 36 carbon atoms, e.g., phenylthio, 2-butoxy-5-t-octylphenylthio, 3-pentadecylphenylthio, 2-carboxyphenylthio, 4-tetradecanamidophenylthio), an alkoxycarbonylamino group (an alkoxycarbonylamino group having from 2 to 36 carbon atoms, e.g., methoxycarbonylamino, tetradecyloxycarbonylamino), a sulfonamido group (an alkyl- and arylsulfonamido group having from 1 to 36 carbon atoms, e.g., methanesulfonamido, butanesulfonamido, octanesulfonamido, hexadecanesulfonamido, benzenesulfonamido, p-toluenesulfonamido, octadecanesulfonamido, 2-methoxy-5-t-butylbenzenesulfonamido), a carbamoyl group (a carbamoyl group having from 1 to 36 carbon atoms, e.g., N-ethylcarbamoyl, N,N-dibutylcarbamoyl, N-(2-dodecyloxyethyl)carbamoyl, N-methyl-N-dodecylcarbamoyl, N-[3-(2,4-di-t-amylphenoxy)propyl]carbamoyl), a sulfamoyl group (a sulfamoyl group having from 1 to 36 carbon atoms, e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (an alkyl- and arylsulfonyl group having from 1 to 36 carbon atoms, e.g., methanesulfonyl, octanesulfonyl, benzenesulfonyl, toluenesulfonyl), an alkoxycarbonyl group (an alkoxycarbonyl group having from 2 to 36 carbon atoms, e.g., methoxycarbonyl, butyloxycarbonyl, dodecyloxycarbonyl, octadecyloxycarbonyl), a heterocyclic oxy group (a heterocyclic oxy group having from 1 to 36 carbon atoms, e.g., 1-phenyltetrazol-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (an acyloxy group having from 2 to 36 carbon atoms, e.g., acetoxy), a carbamoyloxy group (a carbamoyloxy group having from 1 to 36 carbon atoms, e.g., N-methylcarbamoyloxy, N-phenylcarbamoyloxy), a silyloxy group (a silyloxy group having from 3 to 36 carbon atoms, e.g., trimethylsilyloxy, dibutylmethylsilyloxy), an aryloxycarbonylamino group (an aryloxycarbonylamino group having from 7 to 36 carbon atoms, e.g., phenoxycarbonylamino), an imido group (an imido group having from 4 to 36 carbon atoms, e.g., N-succinimido, N-phthalimido, 3-octadecenylsuccinimido), a heterocyclic thio group (a heterocyclic thio group having from 1 to 36 carbon atoms, e.g., 2-benzothiazolylthio, 2,4-diphenoxy-1,3,5-triazole-6-thio, 2-pyridylthio), a sulfinyl group (a sulfinyl group having from 1 to 36 carbon atoms, e.g., dodecanesulfinyl, 3-pentadecylphenylsulfinyl, 3-phenoxypropylsulfinyl), a phosphonyl group (a phosphonyl group having from 1 to 36 carbon atoms, e.g., phenoxyphosphonyl, octyloxyphosphonyl, phenylphosphonyl), an aryloxycarbonyl group (an aryloxycarbonyl group having from 7 to 36 carbon atoms, e.g., phenoxycarbonyl), an acyl group (an acyl group having from 2 to 36 carbon atoms, e.g., acetyl, 3-phenylpropanoyl, benzoyl, 4-dodecyloxybenzoyl), or an azolyl group (e.g., imidazolyl, pyrazolyl, 3-chloropyrazol-1-yl, triazolyl). Of these substituents, those capable of further substitution may be substituted with substituents as enumerated herein for $R_2$.

$R_2$ is preferably an alkoxyl group, an acylamino group, an aliphatic group or an aryl group, and particularly preferably a straight chain or branched alkyl group or a substituted or unsubstituted phenyl group.

X represents a hydrogen atom or a group which is separated when the coupler reacts with the oxidized product of an aromatic primary amine color developing agent, and when X represents a releasable group, examples of said releasable group include a halogen atom, an aryloxy group, an alkyl- or heterocyclic acyloxy group, an alkylaryl- or heterocyclic sulfonyloxy group, a dialkyl- or diarylphosphonoxy group, an alkoxycarbonyloxy group, an aryloxycarbonyloxy group, a heterocyclic oxycarbonyloxy group, a carbamoyloxy group, an alkylaryl- or heterocyclic sulfonyl group, an alkylaryl- or heterocyclic sulfinyl group, an alkylaryl- or heterocyclic thio group, an imido group, an azo group, and a 5- or 6-membered nitrogen-containing heterocyclic group bonded to the coupling position via a nitrogen atom. The alkyl moiety, aryl moiety or heterocyclic moiety contained in these releasable groups may be substituted with the substituents described in $R_2$, when there are two or more substituents they may be the same or different, and these substituents may be substituted with the substituents described in $R_2$.

Specific examples of the releasable group include a fluorine atom, a chlorine atom, a bromine atom, an aryloxy group having from 6 to 30 carbon atoms (e.g., 4-methylphenoxy, 4-chlorophenoxy, 4-methoxyphenoxy, 2-methoxyphenoxy, 4-ethoxycarboxyphenoxy, 3-acetylaminophenoxy), an alkyl- or heterocyclic acyloxy group having from 2 to 30 carbon atoms (e.g., acetoxy, tetradecanoyloxy, morpholinocarbonyloxy), an alkylaryl- or heterocyclic sulfonyloxy group having from 1 to 30 carbon atoms (e.g., methanesulfonyloxy, toluenesulfonyloxy), a dialkyl- or diarylphosphonoxy group having from 1 to 30 carbon atoms (e.g., diethylphosphonoxy, diphenylphosphonooxy), an alkoxycarbonyloxy group having from 2 to 30 carbon atoms (e.g., ethoxycarbonyloxy, i-butoxycarbonyloxy), an arylcarbonyloxy group having from 6 to 40 carbon atoms (e.g., benzoyloxy, 2,6-dichlorobenzoyloxy, 4-octadecyloxybenzoyloxy), an aryloxycarbonyloxy group having from 6 to 40 carbon atoms (e.g., phenoxycarbonyloxy), a carbamoyloxy group having from 1 to 30 carbon atoms (e.g., diethylcarbamoyloxy, diallylcarbamoyloxy), an alkylaryl- or heterocyclic sulfonyl group having from 1 to 30 carbon atoms (e.g., methanesulfonyloxy, toluenesulfonyloxy), an alkylaryl- or heterocyclic sulfinyl group having from 1 to 30 carbon atoms (e.g., phenylsulfinyl), an alkylaryl- or heterocyclic thio group having from 1 to 30 carbon atoms (e.g., ethylthio, 2-butoxy-5-t-octylphenylthio, tetrazolylthio), a heterocyclic oxy group (e.g., pyrimidinoxy, triazinoxy), imidazolyl, pyrazolyl, triazolyl, 2-dihydro-2-oxo-1-pyridyl, phenylazo, and 4-methoxyphenylazo. A releasable group may contain a photographically useful group such as a development inhibitor or development accelerator.

Preferred groups represented by X are a hydrogen atom, a halogen atom, an aryloxy group, a heterocyclic acyloxy group, a dialkylphosphonoxy group, an arylcarbonyloxy group, an arylsulfonyloxy group, an alkoxycarbonyloxy group or a carbamoyloxy group.

The coupler represented by formula (1) may be such that the group represented by $R_2$ contains the residue of the coupler represented by formula (1) and forms a dimer or more polymer, or the group represented by $R_2$ contains polymer chain and forms a homopolymer or copolymer. A typical example of a homopolymer or copolymer containing polymer chain is a homopolymer or copolymer of addition polymer of ethylenically unsaturated compound containing the residue of the coupler represented by formula (1). In this case, the polymer may contain one or more cyan coloring repeating units containing the residue of the coupler represented by formula (1), or the copolymer may contain, as copolymer components, one or more non-coloring ethylenic monomers which do not coupling react with the oxidized product of an aromatic primary amine developing agent such as acrylate, methacrylate, or maleate.

Specific examples of the couplers for use in the present invention are shown below, but the present invention is not limited thereto.

(1)

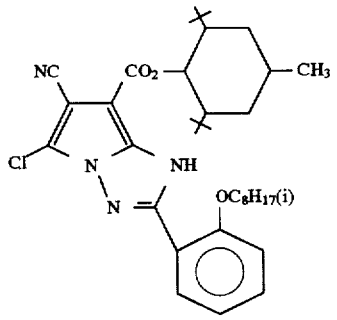

(2)

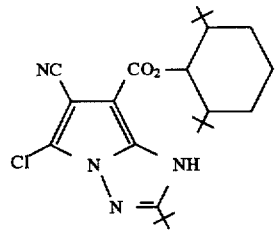

(3)

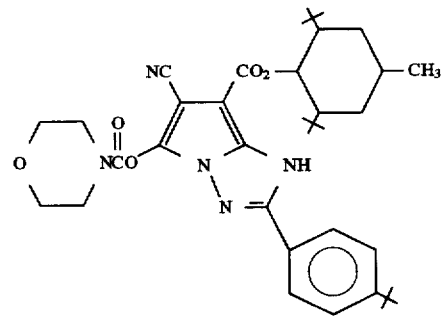

-continued
(4)
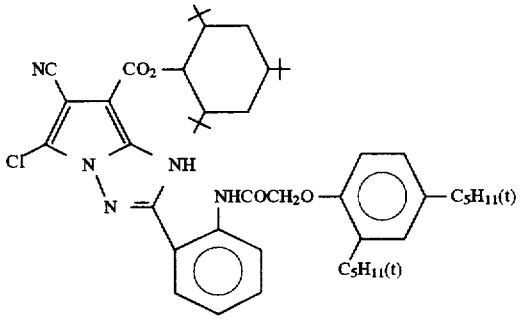
(5)
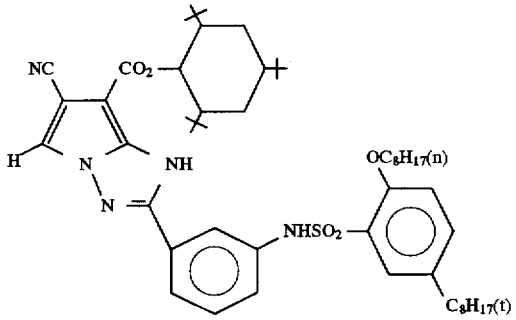
(6)
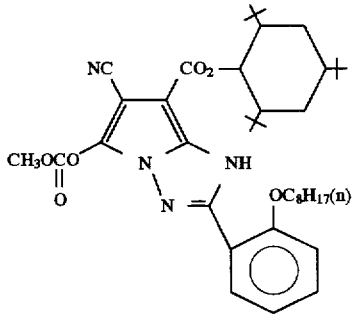
(7)
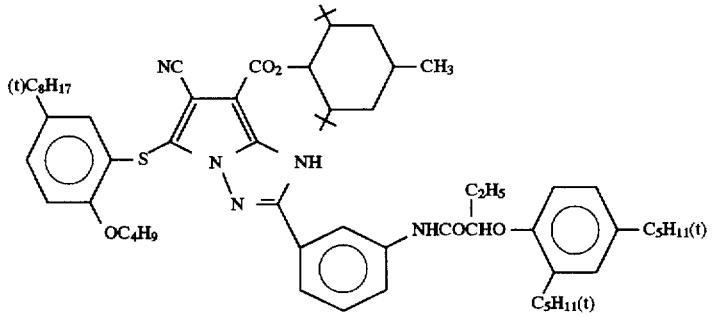

-continued
(8)
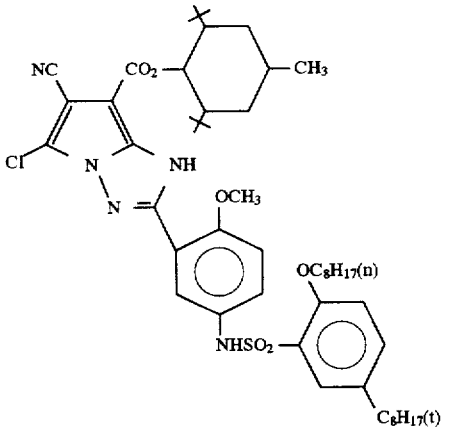
(9)
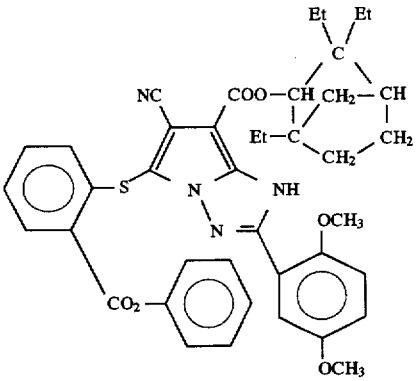
(10)
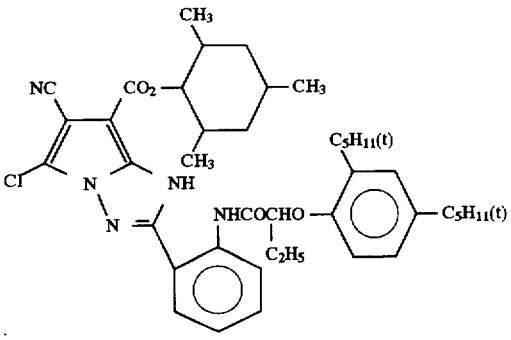
(11)
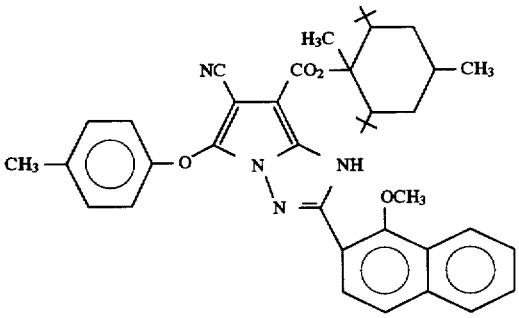

-continued
(12)
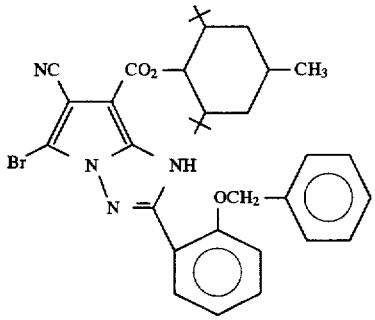
(13)
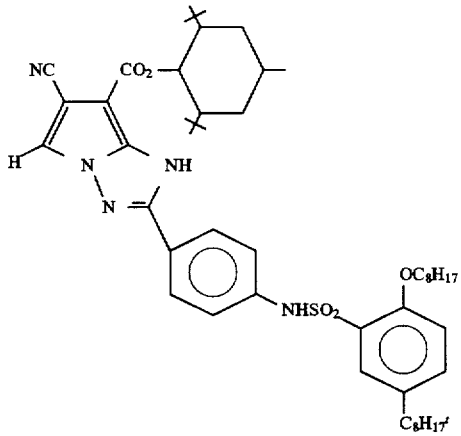
(14)
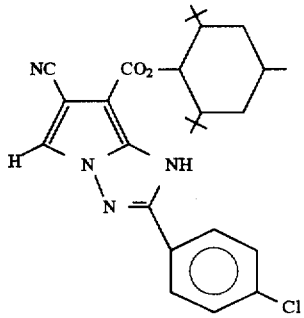
(15)
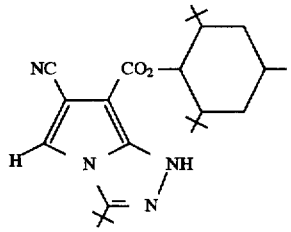

-continued
(16)
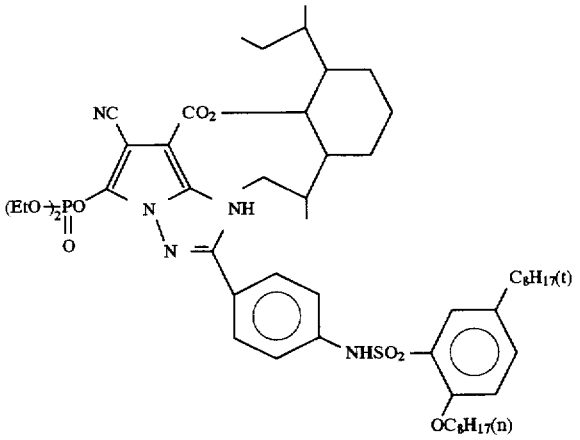
(17)
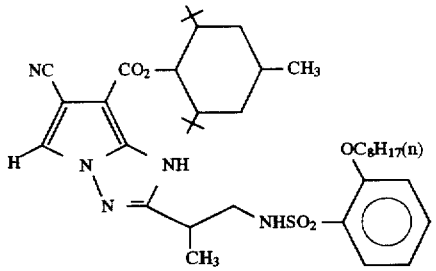
(18)
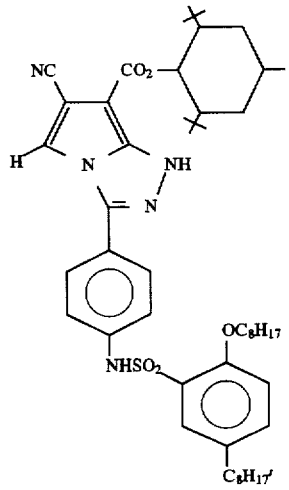
(19)
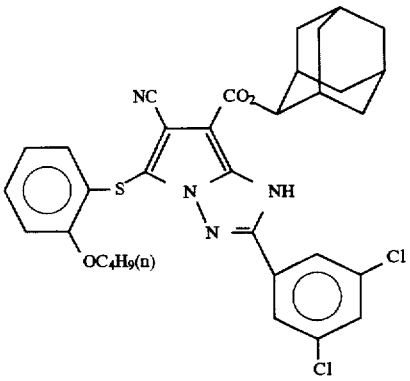

-continued
(20)
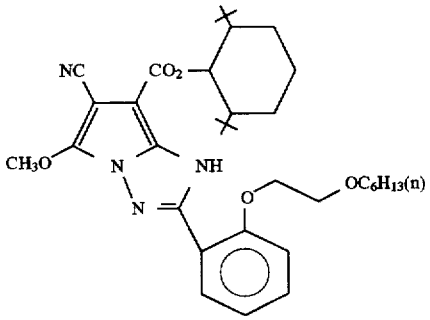
(21)
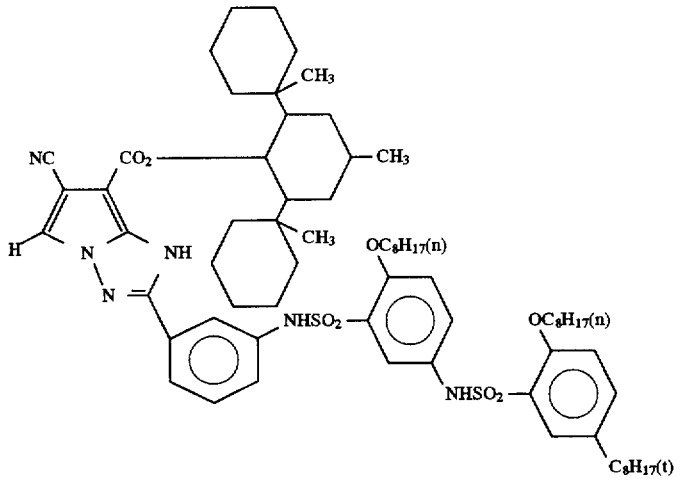
(22)
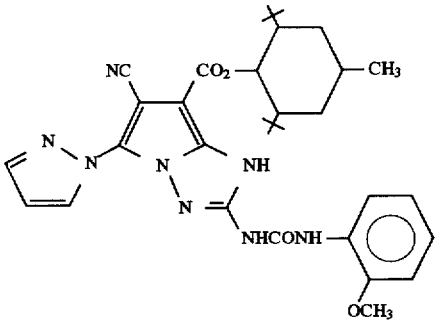
(23)
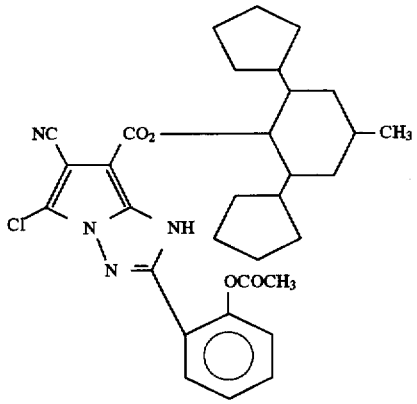

-continued
(24)
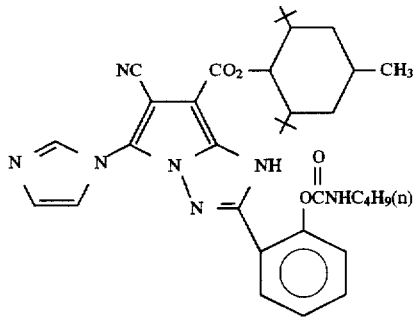
(25)
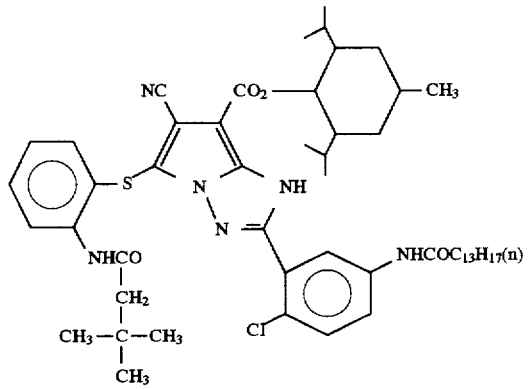
(26)
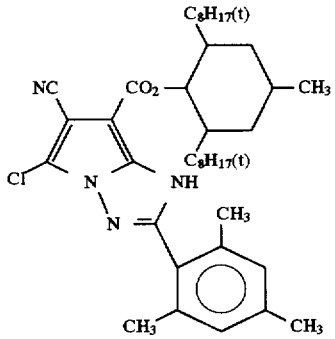
(27)
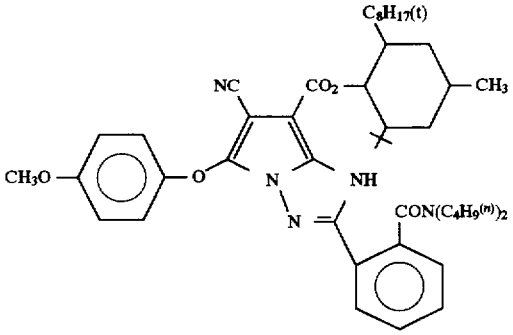

-continued
(28)
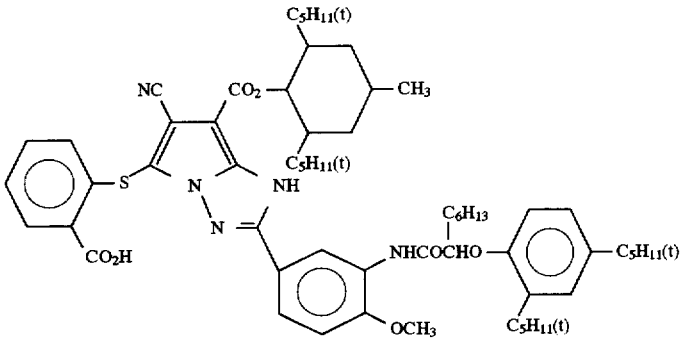
(29)
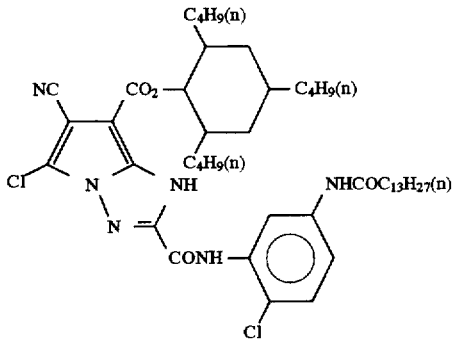
(30)
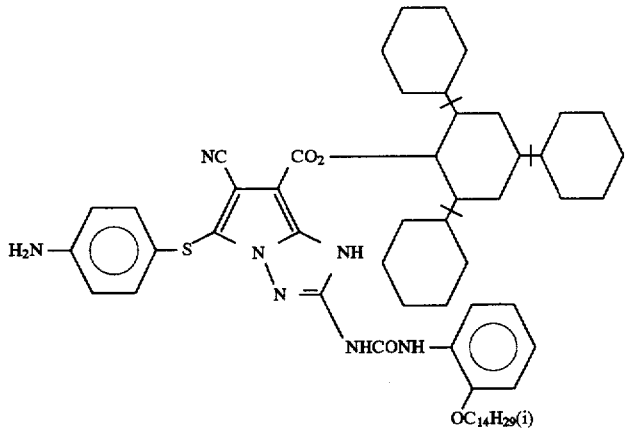
(31)
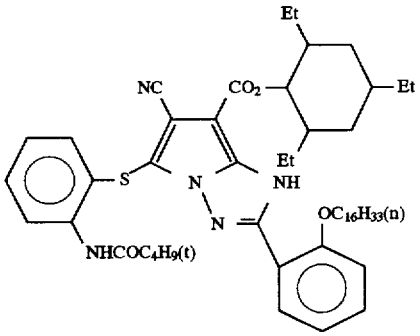

-continued
(32)
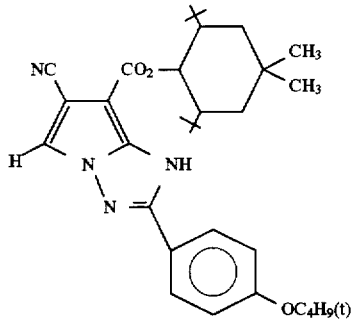
(33)
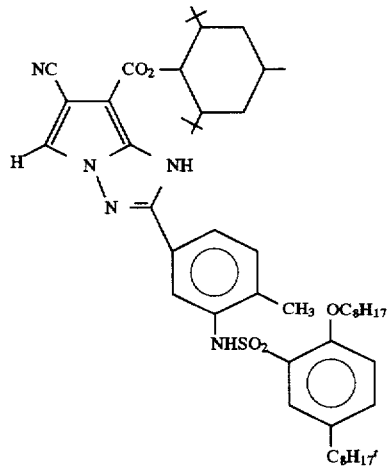
(34)
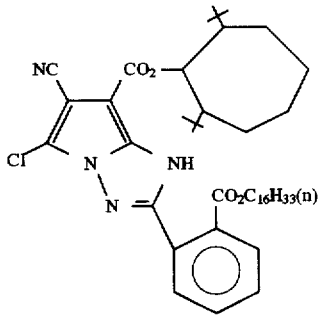
(35)
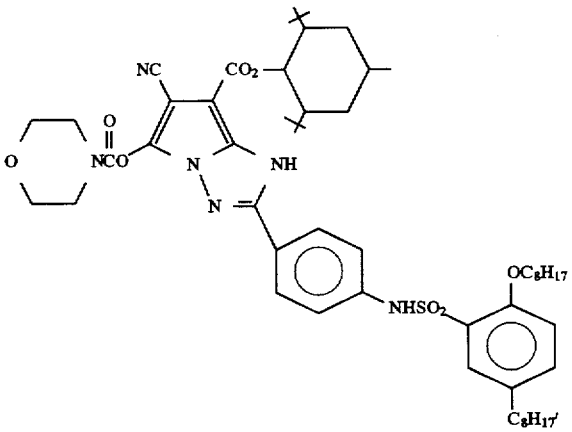

-continued
(36)
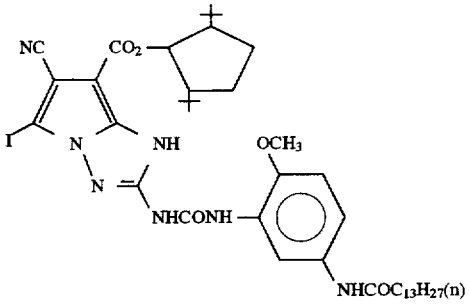
(37)
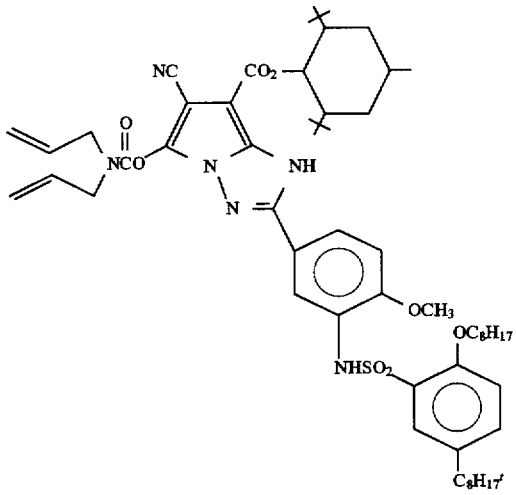
(38)
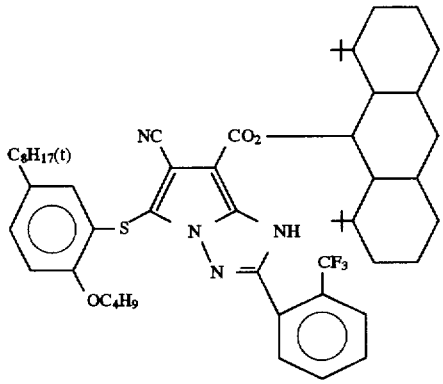
(39)
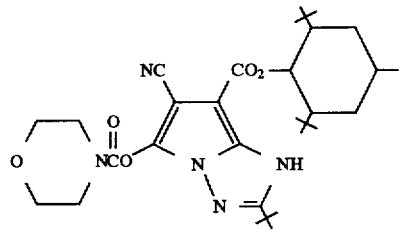

-continued
(40)
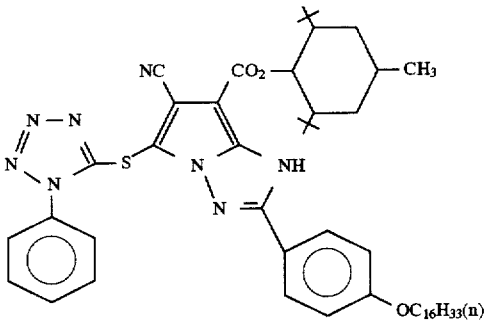
(41)
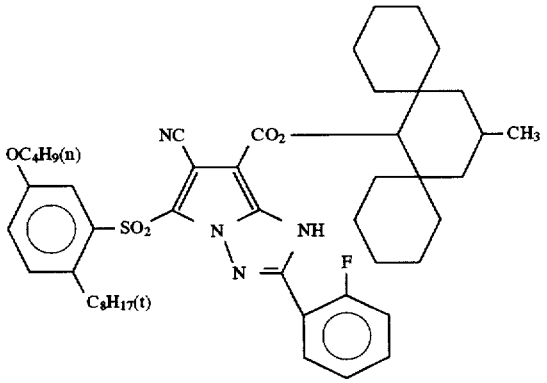
(42)
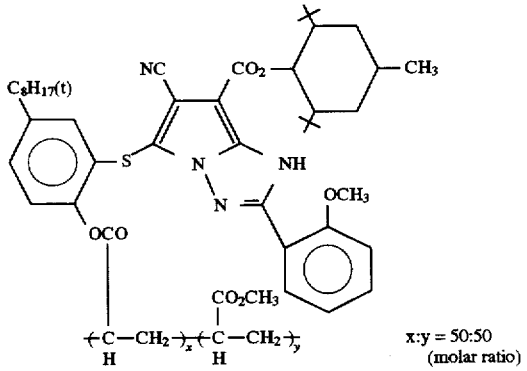
(43)
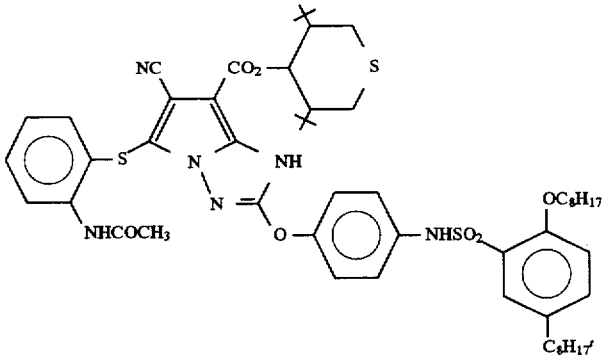

-continued
(44)
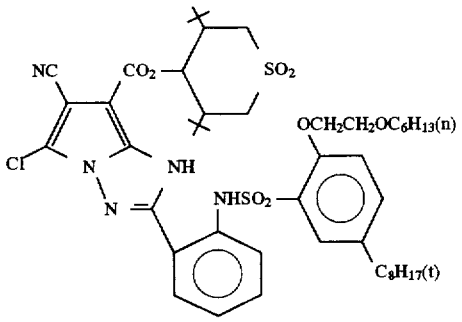
(45)
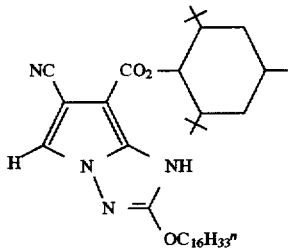
(46)
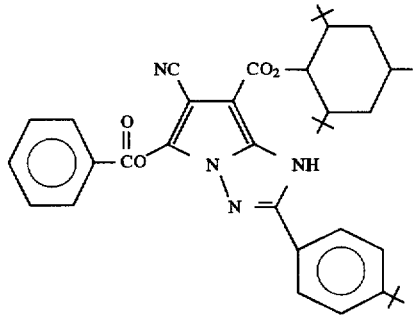
(47)
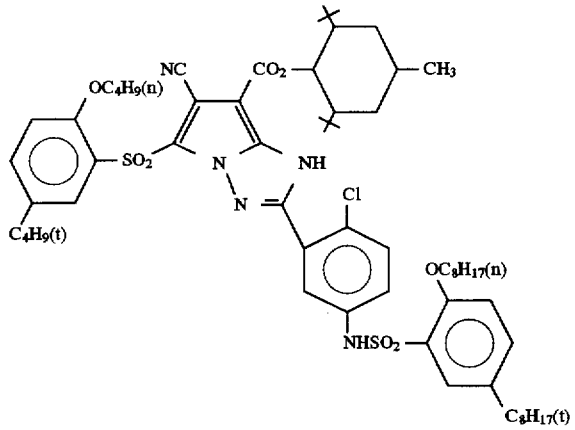

-continued
(48)
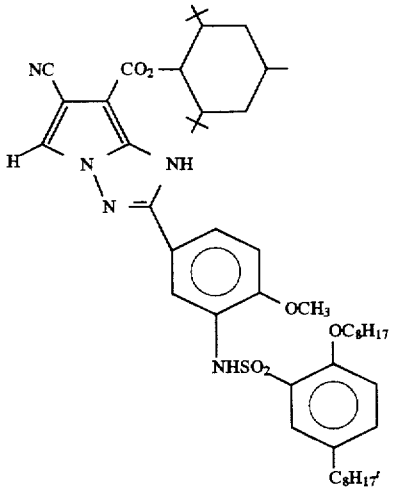
(49)
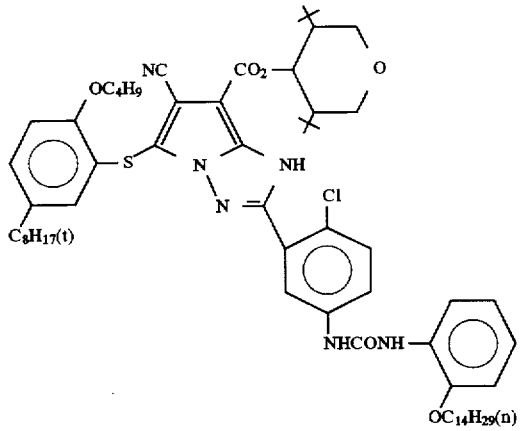
(50)
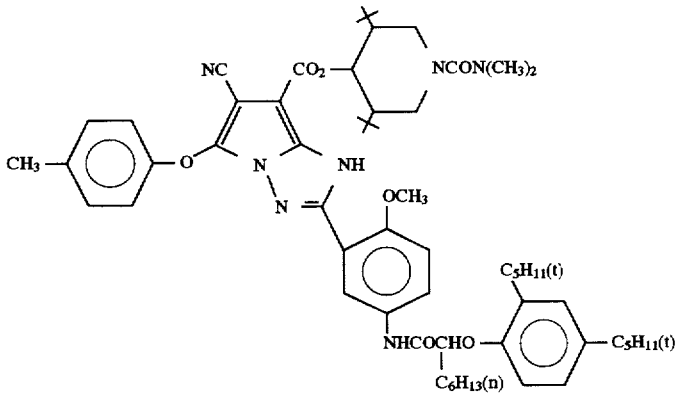
(51)
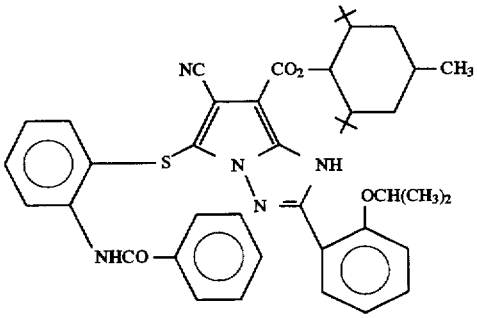

-continued
(52)
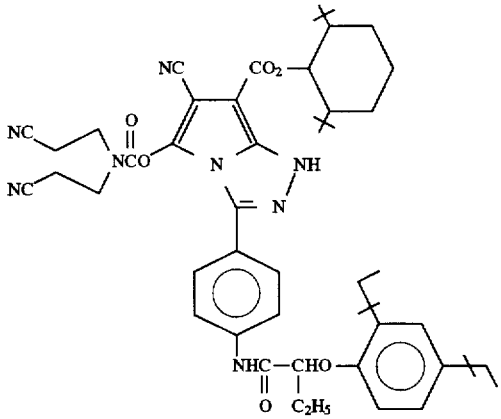
(53)
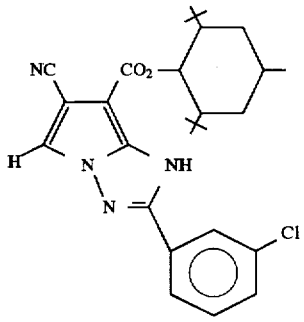
(54)
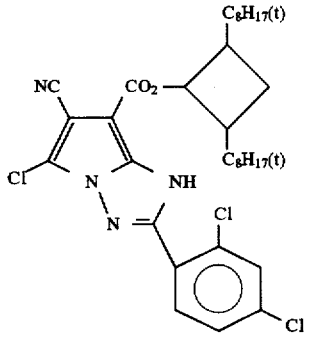
(55)
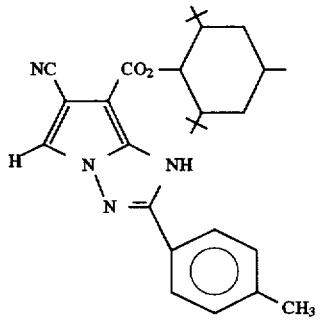

-continued
(56)
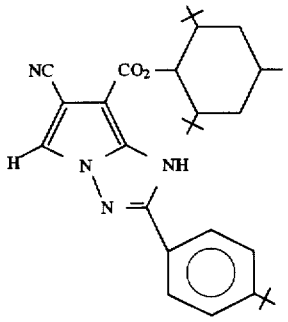
(57)
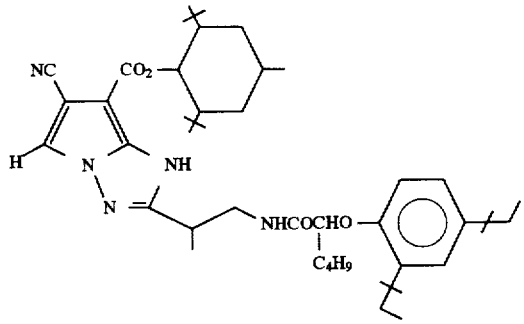
(58)
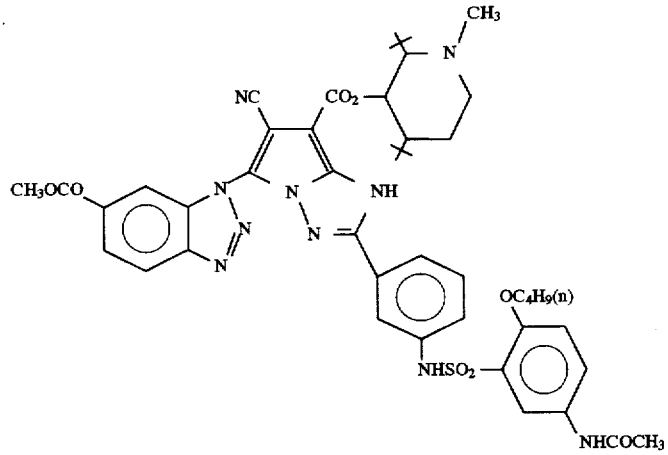
(59)
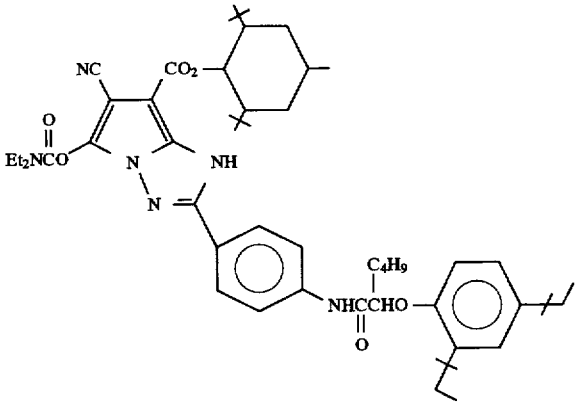

-continued
(60)
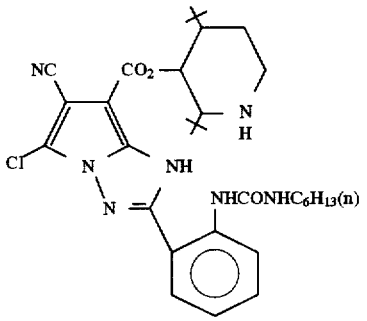
(61)
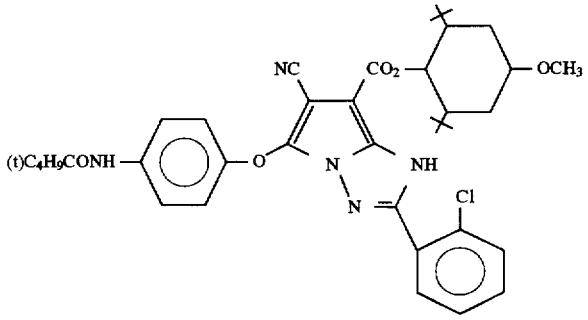
(62)
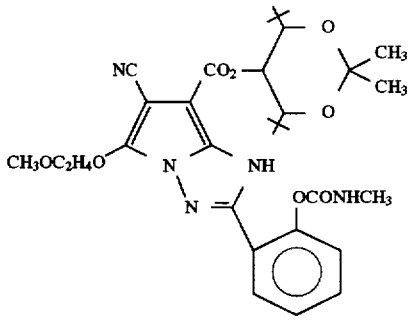
(63)
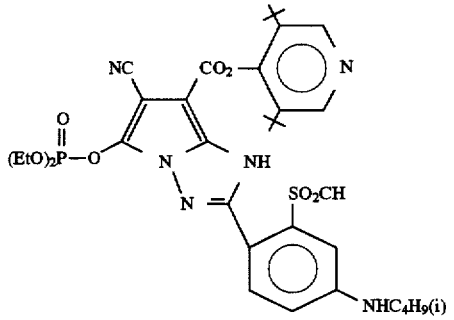
(64)
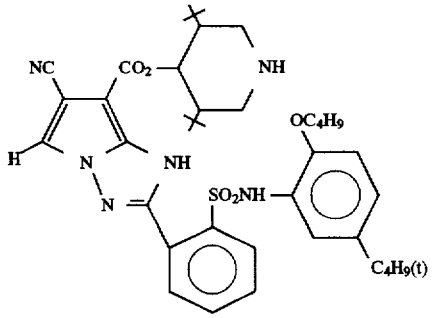

-continued
(65)
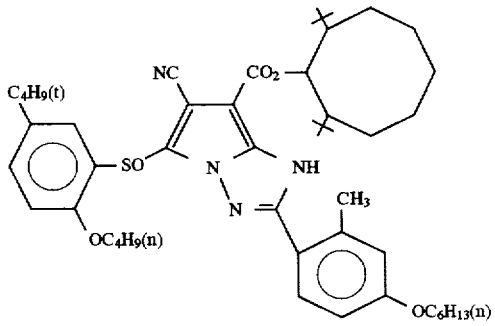
(66)
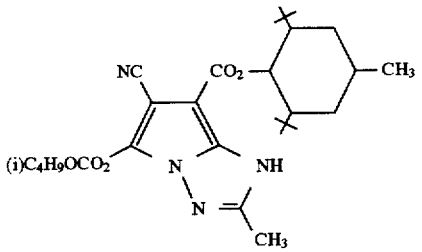
(67)
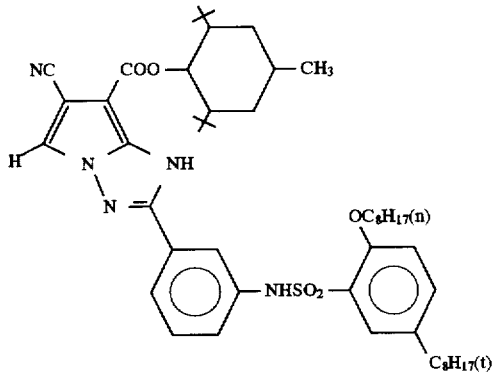
(68)
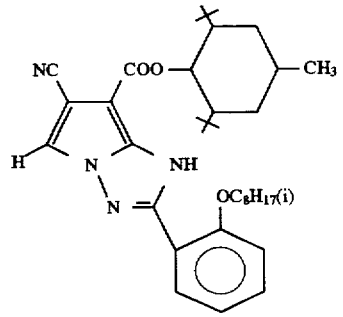
(69)
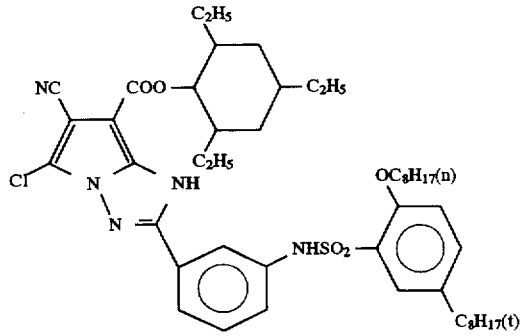

-continued (70)

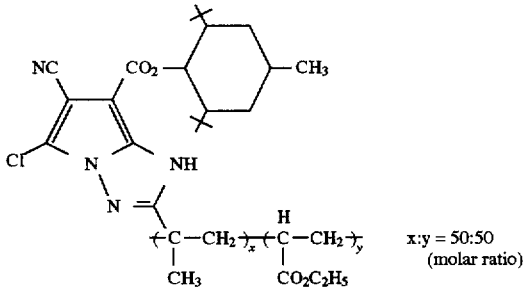

x:y = 50:50 (molar ratio)

(71)

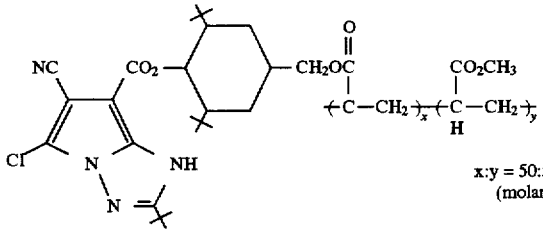

x:y = 50:50 (molar ratio)

(72)

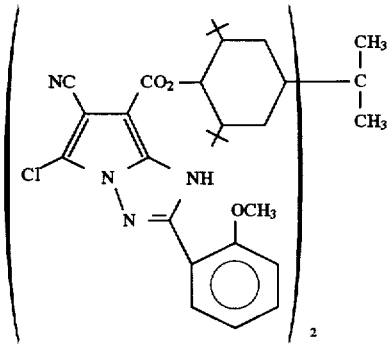

The compound represented by formula (1) of the present invention can be synthesized, for example, according to the methods disclosed, for example, in *J. C. S.*, page 518 (1961), *J. C. S.*, page 5149 (1962), *Angew. Chem.*, Vol. 72, page 956 (1960), Berichte, Vol. 97, page 3436 (1964), or JP-A-5-163254.

The cyan coupler for use in the present invention can be used in a silver halide emulsion layer or in a light-insensitive layer. When the cyan coupler for use in the present invention is used in a silver halide emulsion layer, the amount used is from 0.005 to 1 mol, preferably from 0.01 to 0.5 mol, more preferably from 0.02 to 0.4 mol, per mol of the silver halide. Also, when the cyan coupler for use in the present invention is used in a light-insensitive layer, the amount used is from $1.0\times10^{-5}$ to $1.0\times10^{-3}$ mol/m$^2$, preferably from $5.0\times10^{-5}$ to $5.0\times10^{-4}$ mol/m$^2$.

The cyan couplers for use in the present invention can be used in combination of two or more, or can be used in combination with known cyan couplers such as phenol couplers and naphthol couplers in such a degree that the effects of the present invention are not impaired. Specifically, the cyan couplers for use in the present invention are used in proportion of 25% or more, preferably 50% or more, and more preferably 70% or more. Further, the use amount based on the silver halide is within the range described above to the amount of the entire cyan coupler.

The cyan coupler for use in the present invention can be incorporated into a color photographic material by various known methods.

In an oil-in-water dispersion method which is one of the known dispersion methods, a method of using a low boiling point organic solvent (e.g., ethyl acetate, butyl acetate, methyl ethyl ketone, isopropanol) can be applied to coat fine dispersion by which the low boiling point organic solvent does not substantially remain in the dried film. Moreover, when using a high boiling point organic solvent, any solvent having a boiling point of 175° C. or more at atmospheric pressure can be used, and one or two or more can be used in admixture optionally. The proportion of the cyan coupler for use in the present invention to these high boiling point organic solvents may be wide range, but is in the range of 5.0 or less per 1 g of the coupler in weight ratio, preferably from 0 to 2.0, and more preferably from 0.01 to 1.0. In addition, a latex dispersion method described later can also be used.

Further, the cyan coupler for use in the present invention can be used in admixture with or coexistence with various couplers or mixtures described later. Furthermore, the cyan coupler for use in the present invention can be used in admixture with the known additives for the purpose of improvement in hue, discoloration, etc.

The compound represented by formula (2) will be described in detail below.

In formula (2), $R_2$, represents an alkyl group or an aryl group which may be substituted, and preferred examples of the substituents include an alkyl group having 4 or more carbon atoms (e.g., n-butyl, n-hexyl, 2-ethylhexyl, n-octyl, dodecyl, isostearyl), and a substituted or unsubstituted phenyl group (e.g., phenyl, naphthyl, 4-methoxyphenyl, 4-morpholinophenyl, 4-methoxyethoxyphenyl, 4-methoxy-3-benzenesulfonylaminophenyl, 2-butyl-5-t-octylphenyl, 3-carboxyphenyl).

Examples of the substituents represented by $R_{22}$ include those described in $R_2$ in formula (1), and preferred examples include an alkyl group, an alkenyl group, an aryl group, an alkoxyl group, a halogen atom, a carboxyl group and a sulfo group. m represents 0 or an integer of 1, 2, 3 or 4, and when m is 2 or more, the plurality of $R_{22}$'s may be preferably bonded with each other to form a ring, for example, a cyclohexyl ring or a phenyl ring.

Specific examples of the compounds represented by formula (2) are shown below, but the present invention is not limited thereto.

(SC-1)

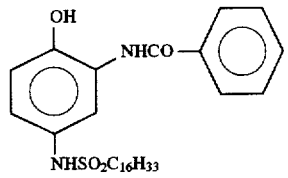

(SC-2)

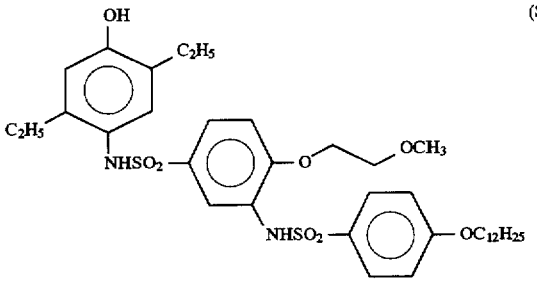

(SC-3)

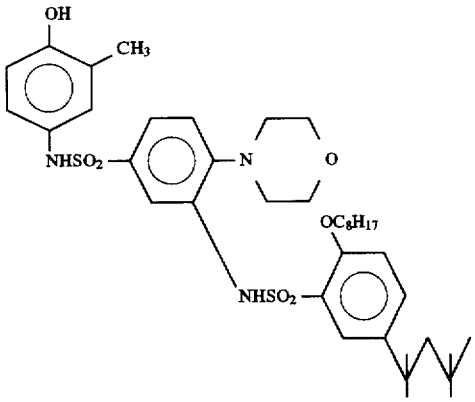

(SC-4)

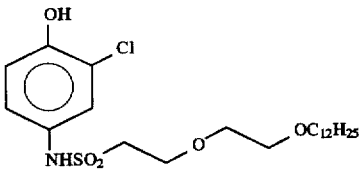

(SC-5)

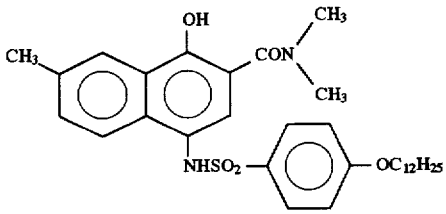

-continued (SC-6)

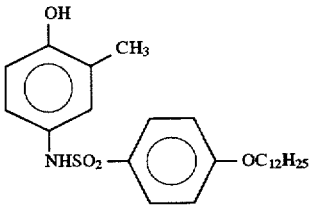

(SC-7)

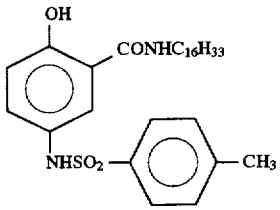

(SC-8)

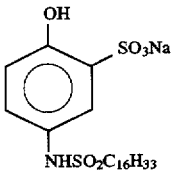

(SC-9)

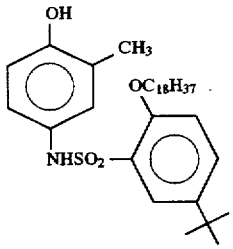

(SC-10)

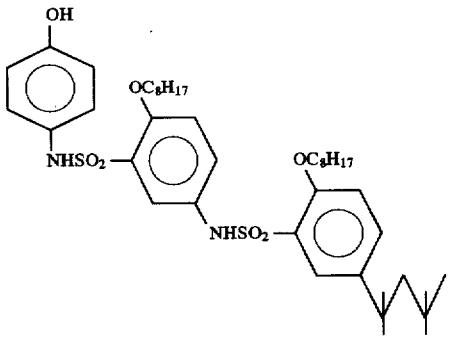

(SC-11)

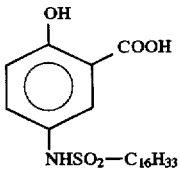

(SC-12)

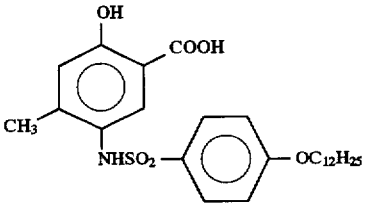

-continued
(SC-13)
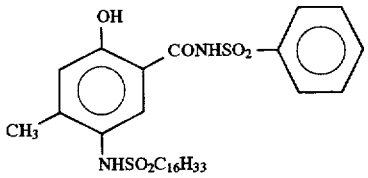
(SC-14)
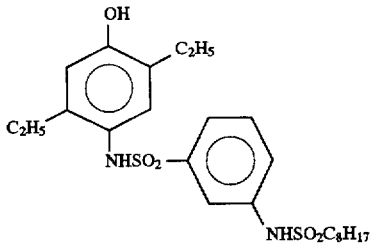
(SC-15)
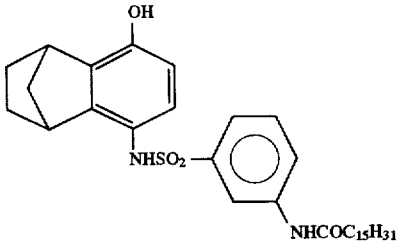
(SC-16)
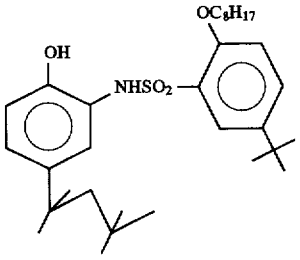
(SC-17)
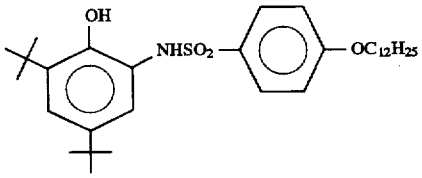
(SC-18)
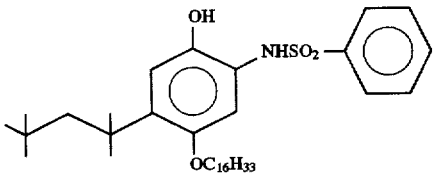
(SC-19)
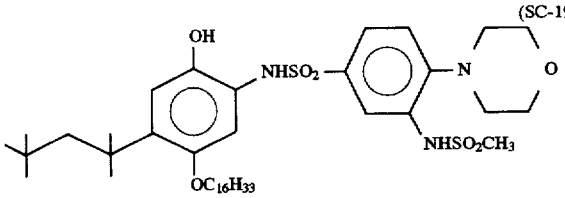
-continued
(SC-20)
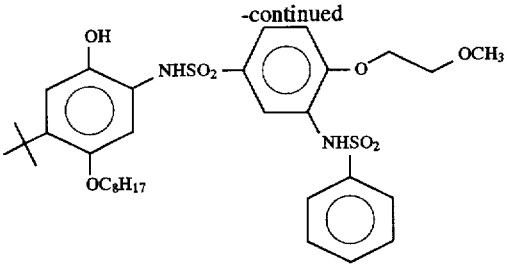
(SC-21)
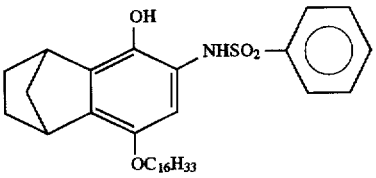
(SC-22)
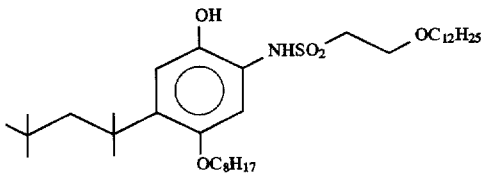
(SC-23)
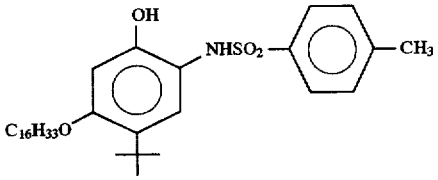
(SC-24)
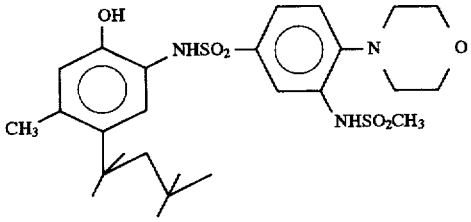
(SC-25)
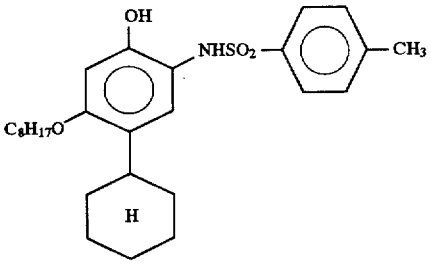
(SC-26)
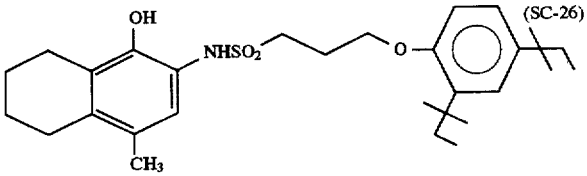
(SC-27)
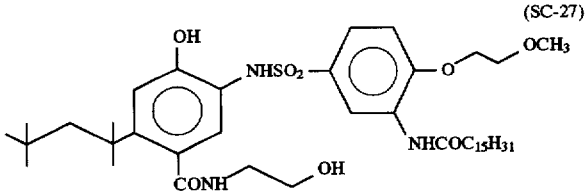

-continued

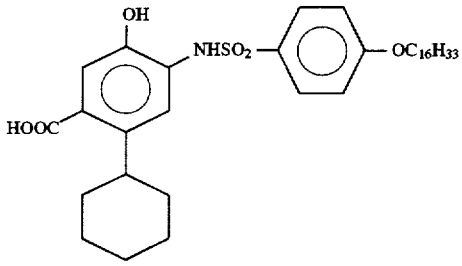

(SC-28)

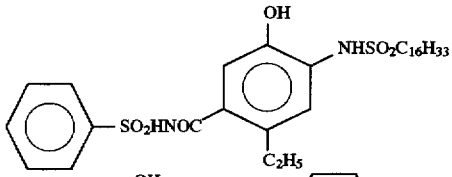

(SC-29)

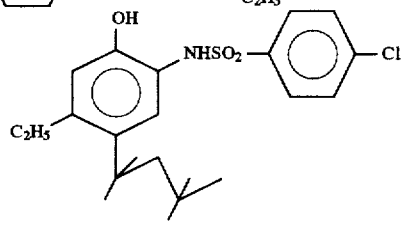

(SC-30)

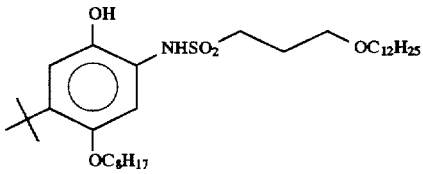

(SC-31)

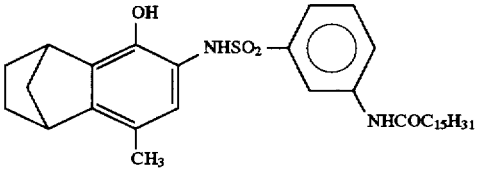

(SC-32)

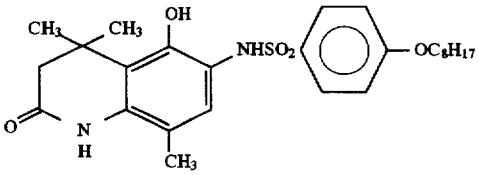

(SC-33)

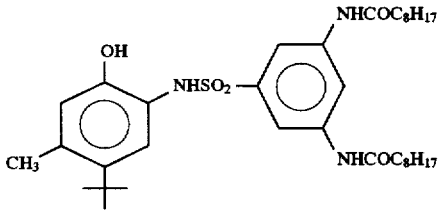

(SC-34)

The compounds which react with the oxidized product of an aromatic primary amine color developing agent but substantially do not form color images for use in the present invention are described in detail below.

The mechanism where the compound reacts with the oxidized product of an aromatic primary amine color developing agent but substantially does not form color images may be any such mechanism known in the art. The following mechanisms are listed for example purposes.

1. A mechanism where a compound coupling reacts with the oxidized product of an aromatic primary amine color developing agent and forms a dye but the dye is movable or becomes movable via a succeeding reaction and escapes into a processing solution during processing (a so-called wash-out coupler).
2. A mechanism where the formed product by a coupling reaction does not have absorption in a visible light region (a so-called colorless coupler).

1. Preferred wash-out couplers are represented by the following formula (C-1):

A-B (C-1)

wherein A represents a group which is capable of coupling with the oxidized product of an aromatic primary amine color developing agent and from which a movable dye is formed by a coupling reaction, so that the dye does not color a photographic material processed. Every known skeletons as photographic couplers can be used as a group capable of coupling.

Examples of known skeletons include, for example, cyan coupler residues such as phenol, naphthol, pyrrolo-[1,2-b][1,2,4]triazole, pyrrolo[2,1-c][1,2,4]triazole, and 2,4-diphenylimidazole;

Magenta coupler residues such as 5-pyrazolone, pyrazolo[1,5-a]benzimidazole, pyrazolo[1,5-b][1,2,4]triazole, pyrazolo[5,1-c][1,2,4]triazole, imidazo[1,2-b]pyrazole, pyrrolo[1,2-b][1,2,4]triazole, and pyrazolo[1,5-b]pyrazole;

Yellow coupler residues such as pivaloylacetamide, benzoylacetamide, malondiester, malondiamide, benzothiazolylacetamide, malonestermonoamide, benzoxazolylacetamide, benzimidazolylacetamide, quinazolin-4-one-2-ylacetamide, and cycloalkanoylacetamide.

Further, indanone type or acetophenone type coupler residues can be cited as skeletons which do not substantially form colored compounds.

Of these, cyan coupler residues of phenol and naphthol and yellow coupler residues are preferred.

A, on which a hydrophilic group for accelerating escape to a processing solution is substituted, is also preferred, in addition to an atomic group minimum necessary for coupling. Preferred examples of the substituents as hydrophilic groups include a carboxyl group, a sulfo group, a hydroxyl group, a sulfamoyl group, a sulfonylamino group, an acylsulfonylamino group, a carbamoyl group, or an acylamino group.

In the formula, B represents a group bonded to the coupling position of the group represented by A through an oxygen atom, a sulfur atom or a nitrogen atom and necessary to fix the compound represented by the formula (C-1) at a specific position in the photographic material during storage or processing.

B is preferably substituted with a group imparting non-diffusing ability such as a straight or branched chain alkyl group having from 8 to 30 carbon atoms (e.g., decyl, dodecyl, hexadecyl, octadecyl, t-octyl, 3-(3-pentadecylphenoxy)propyl, 3-(2,4-di-t-amylphenoxy)propyl), or an aryl group (e.g., 4-t-octylphenyl, 2-octadecyloxyphenyl, 2,4-di-t-amylphenyl).

The above wash-out couplers are disclosed in detail in JP-A-6-83002, pages 33 to 42.

2. As colorless couplers, the couplers substituted with an alkyl group at the coupling position as disclosed in German Patent 1,155,675, British Patent 861,138, U.S. Pat. Nos. 3,876,428 and 3,912,513 are known. In particular, pyrazolone couplers substituted with an alkyl group at the coupling position are preferred.

Specific examples of the compounds which react with the oxidized product of an aromatic primary amine color developing agent but substantially do not form color images are shown below, but the present invention is not limited thereto.

Q-(1)

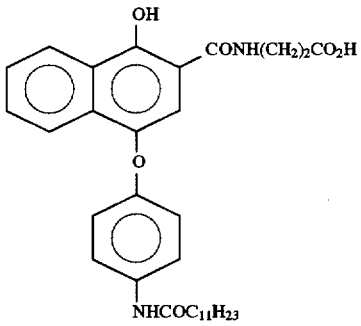

Q-(2)

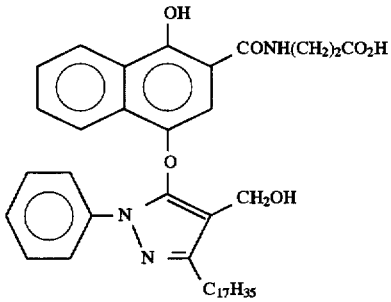

Q-(3)

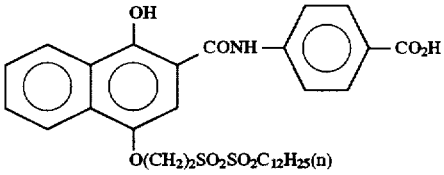

Q-(4)

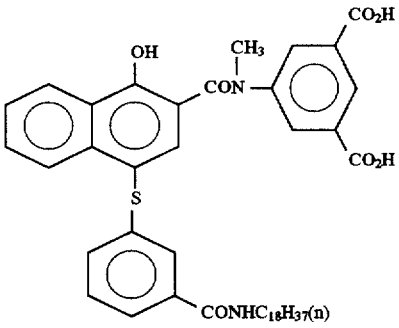

Q-(5)

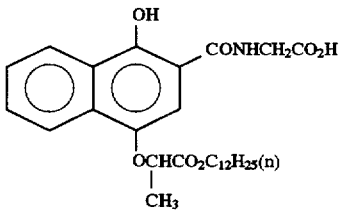

-continued

Q-(6)

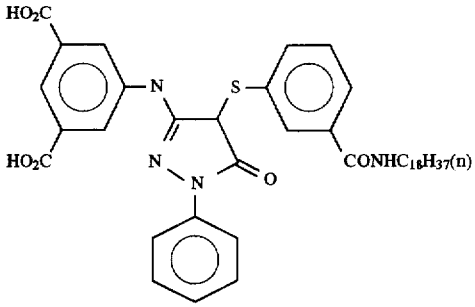

Q-(7)

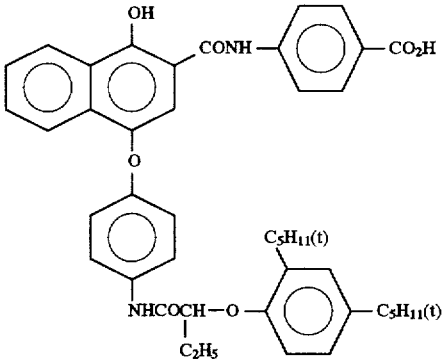

Q-(8)

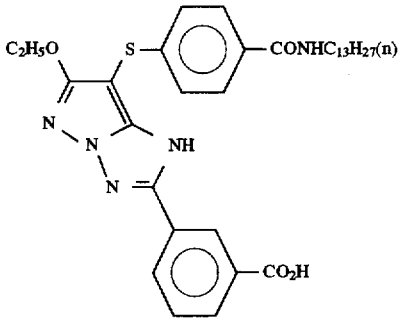

Q-(9)

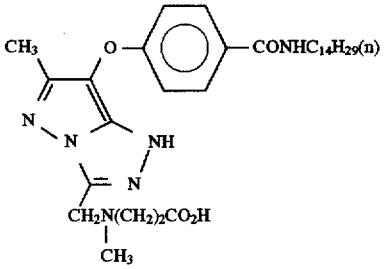

Q-(10)

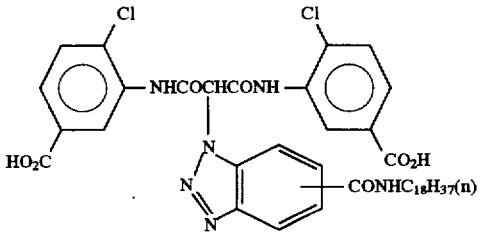

-continued
Q-(11)
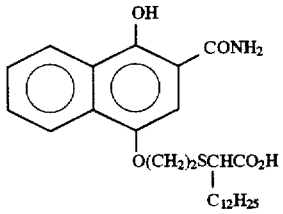
Q-(12)
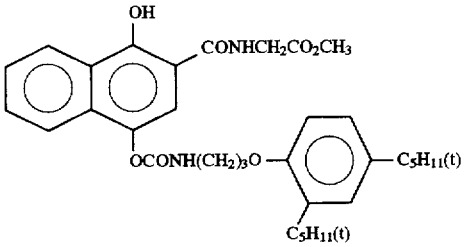
Q-(13)
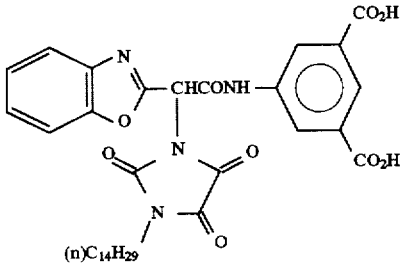
Q-(14)
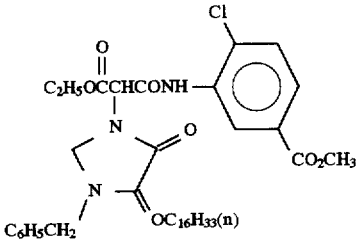
Q-(15)
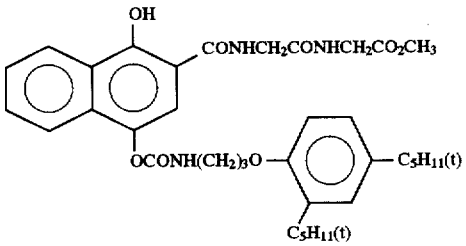
Q-(16)
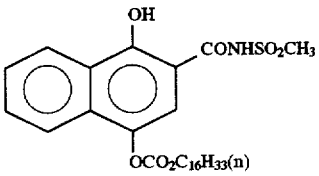
-continued
Q-(17)
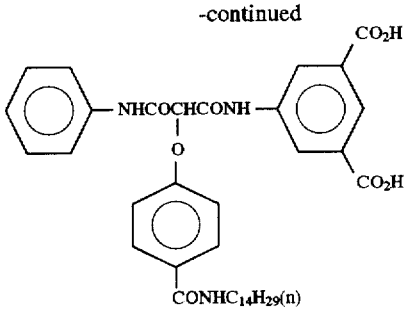
Q-(18)
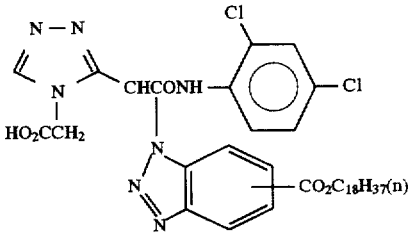
Q-(19)
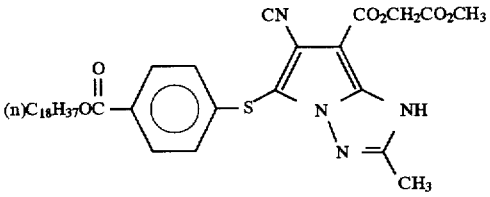
Q-(20)
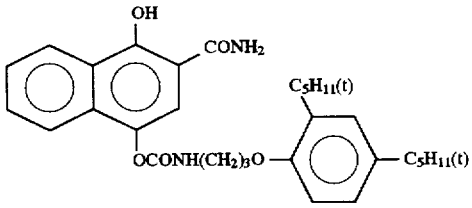
Q-(21)
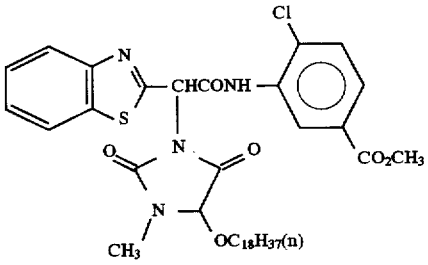
Q-(22)
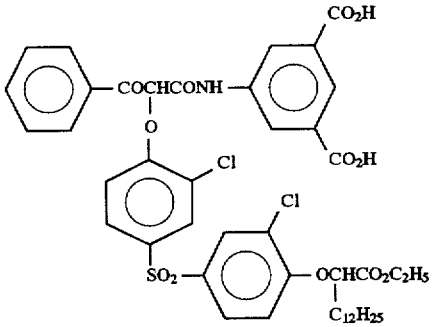

-continued
Q-(23)
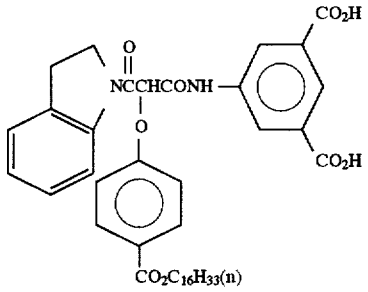
Q-(24)
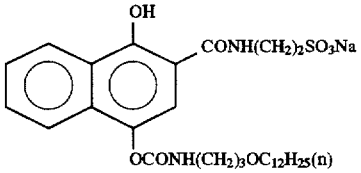
Q-(25)
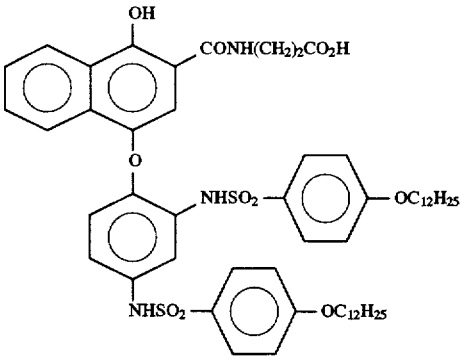
Q-(26)
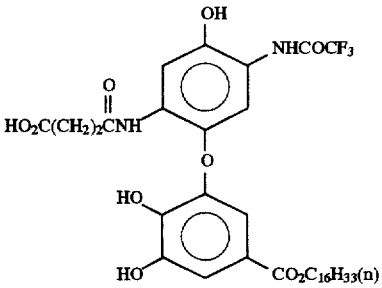
Q-(27)
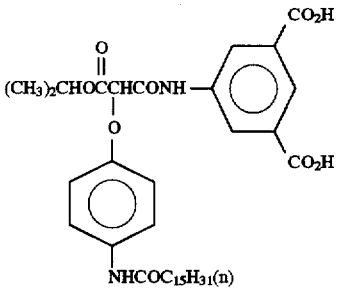
Q-(28)
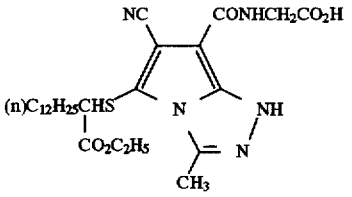
-continued
Q-(29)
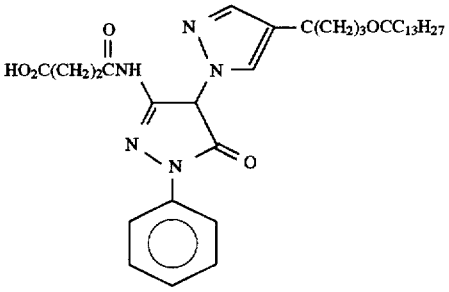
Q-(30)
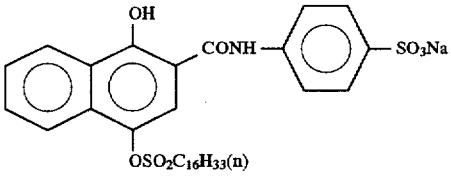
Q-(31)
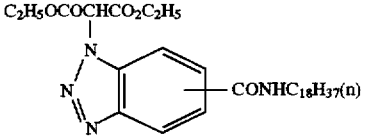
Q-(32)
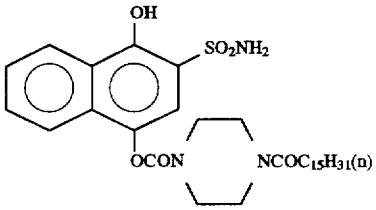
Q-(33)
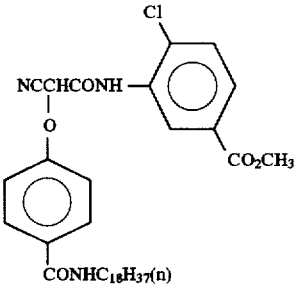
Q-(34)
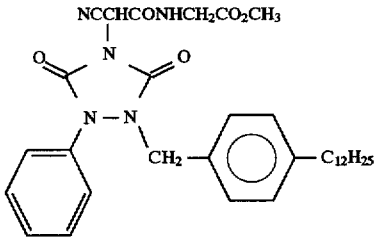
(WC-1)
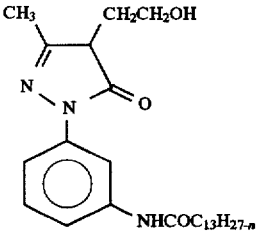

-continued (WC-2)

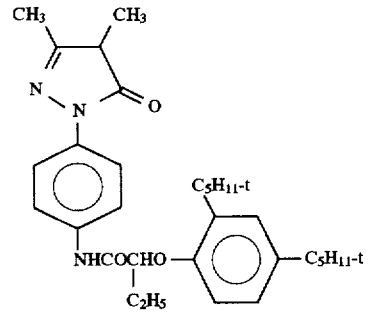

(WC-3)

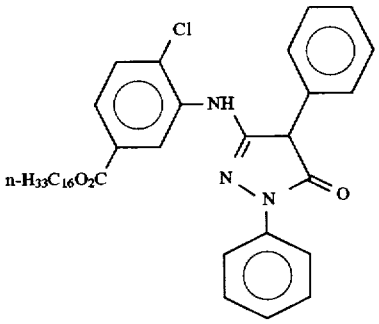

(WC-4)

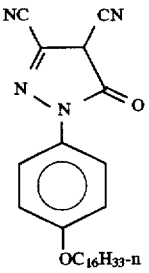

(WC-5)

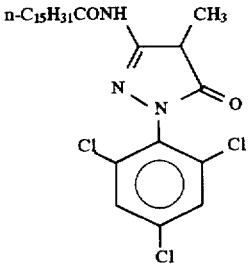

(WC-6)

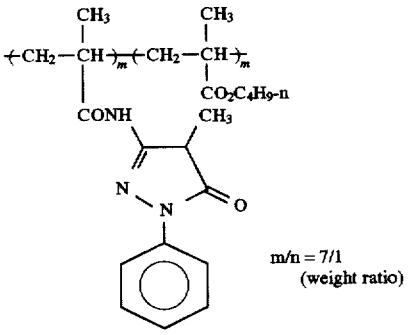

m/n = 7/1 (weight ratio)

(WC-7)

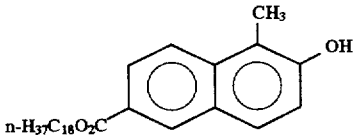

-continued (WC-8)

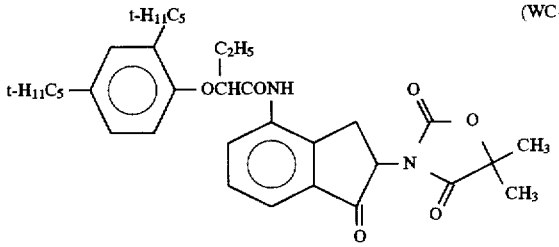

(WC-9)

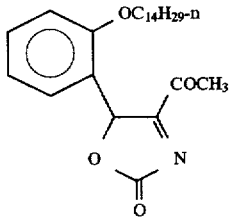

(WC-10)

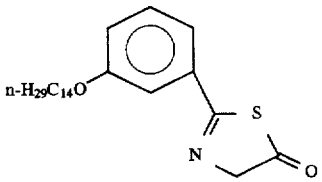

(WC-11)

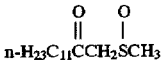

(WC-12)

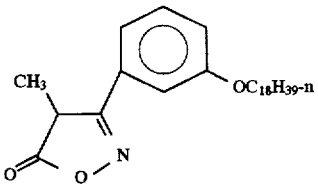

The compounds represented by formula (2) or the compounds which coupling react with the oxidized product of an aromatic primary amine color developing agent but substantially do not participate in forming color images may be incorporated into any layer but is preferably added to a red-sensitive emulsion layer or an interlayer. In particular, they are preferably added to the red-sensitive emulsion layer to which the coupler represented by formula (1) is incorporated, or the interlayer between two red-sensitive emulsion layers having different sensitivities and at least one of which contains the coupler represented by formula (1).

The addition amount of the compounds represented by formula (2) or the compounds which coupling react with the oxidized product of an aromatic primary amine color developing agent but substantially do not participate in forming color images is from 0.001 to 2.0 g/m$^2$ and preferably from 0.01 to 1.0 g/m$^2$. Further, when they are added to the same light-sensitive emulsion layer to which the cyan coupler for use in the present invention is incorporated, they are preferably used in an amount of from 0.05 to 5 mol, and particularly preferably from 1 to 3 mol, per mol of the cyan coupler.

The compounds represented by formula (2) and the compounds which coupling react with the oxidized product of an aromatic primary amine color developing agent but substantially do not form color images may be used alone or in combination. Non-color-forming couplers comprising cyan coupler residues of phenol and naphthol or yellow coupler residues or pyrazolone couplers substituted with an alkyl group at the coupling position are particularly preferred.

In the combination of the present invention, known color mixing preventives (hydroquinones, hydrazines) and known discoloration inhbitors can be used in combination in such a degree that the effects of the present invention are not impaired.

With respect to the silver halide photographic emulsion for use in the present invention, and various techniques and inorganic and organic materials which can be used in the silver halide photogdraphic material using the silver halide photographic emulsion for use in the present invention, in general, those disclosed in *Research Disclosure,* Nos. 308119 (1989) and 37038 (1995) can be used.

In addition to these, more specifically, for example, techniques and inorganic and organic materials which can be used in the color photographic material to which the silver halide photographic emulsion for use in the present invention is applicable are disclosed in the following places of EP-A-436938 and the patents cited in the following.

| | |
|---|---|
| 1) Layer Structure | line 34, page 146 to line 25, page 147 |
| 2) Silver Halide Emulsion | line 26, page 147 to line 12, page 148 |
| 3) Yellow Coupler | line 35, page 137 to line 33, page 146, lines 21 to 23, page 149 |
| 4) Magenta Coupler | lines 24 to 28, page 149; line 5, page 3 to line 55, page 25 of EP-A-421453 |
| 5) Cyan Coupler Which Can Be Used in Combination | lines 29 to 33, page 149; line 28, page 3 to line 2, page 40 of EP-A-432804 |
| 6) Polymer Coupler | lines 34 to 38, page 149; line 39, page 113 to line 37, page 123 of EP-A-435334 |
| 7) Colored Coupler | line 42, page 53 to line 34, page 137, lines 39 to 45, page 149 |
| 8) Other Functional Coupler | line 1, page 7 to line 41, page 53, line 46, page 149 to line 3 page 150; line 1, page 3 to line 50, page 29 of EP-A-435334 |
| 9) Preservative, Antibacterial Agent | lines 25 to 28, page 150 |
| 10) Formalin Scavenger | lines 15 to 17, page 149 |
| 11) Other Additives Which Can Be Used in Combination | lines 38 to 47, page 153; line 21, page 75 to line 56, page 84 of EP-A-421453, line 40, page 27 to line 40, page 37 of EP-A-421453 |
| 12) Dispersion Method | lines 4 to 24, page 150 |
| 13) Support | line 32 to 34, page 150 |
| 14) Film Thickness, Physical Properties of Film | lines 35 to 49, page 150 |
| 15) Color Development Process | line 50, page 150 to line 47, page 151 |
| 16) Desilvering Process | line 48, page 151 to line 53, page 152 |
| 17) Automatic Processor | line 54, page 152 to line 2, page 153 |
| 18) Washing and Stabilizing Processes | lines 3 to 37, page 153 |

The silver halide photographic material of the present invention is applied to photographic materials of ISO speed of 2000 or less under daylight illuminant measured according to the method disclosed in ISO 2240.

The present invention will be illustrated in more detail with reference to the following examples, but these are not to be construed as limiting the invention.

EXAMPLE 1

Preparation of Sample No. 101:

A multilayer color photographic material was prepared as Sample No. 101 by coating each layer having the following composition on an undercoated cellulose triacetate film support having the thickness of 127 μm. The numeral corresponding to each component indicates the addition amount per $m^2$. The function of the compounds added is not limited to the use described.

| | | |
|---|---|---|
| First Layer: Antihalation Layer | | |
| Black Colloidal Silver | | 0.10 g |
| Gelatin | | 1.90 g |
| Ultraviolet Absorbing Agent U-1 | | 0.10 g |
| Ultraviolet Absorbing Agent U-3 | | 0.040 g |
| Ultraviolet Absorbing Agent U-4 | | 0.10 g |
| High Boiling Point Organic Solvent Oil-1 | | 0.10 g |
| Microcrystal Solid Dispersion of Dye E-1 | | 0.10 g |
| Second Layer: Interlayer | | |
| Gelatin | | 0.40 g |
| Compound Cpd-C | | 5.0 mg |
| Compound Cpd-J | | 5.0 mg |
| Compound Cpd-K | | 3.0 mg |
| High Boiling Point Organic Solvent Oil-3 | | 0.10 g |
| Dye D-4 | | 0.80 mg |
| Third Layer: Interlayer | | |
| Surface and Interior Fogged Fine Grain Silver Iodobromide Emulsion (average grain size: 0.06 μm, variation coefficient: 18%, AgI content: 1 mol %) | silver amount: | 0.050 g |
| Yellow Colloidal Silver | silver amount: | 0.030 g |
| Gelatin | | 0.40 g |
| Fourth Layer: Low Sensitivity Red-Sensitive Emulsion Layer | | |
| Emulsion A | silver amount: | 0.35 g |
| Emulsion B | silver amount: | 0.30 g |
| Gelatin | | 0.80 g |
| Coupler C-1 | | 0.10 g |
| Coupler C-2 | | 0.10 g |
| Coupler C-9 | | 0.010 g |
| Compound Cpd-C | | 5.0 mg |
| Compound Cpd-J | | 5.0 mg |
| High Boiling Point Organic Solvent Oil-2 | | 0.10 g |
| High Boiling Point Organic Solvent Oil-1 | | 0.05 g |
| Additive P-1 | | 0.10 g |
| Fifth Layer: Middle Sensitivity Red-Sensitive Emulsion Layer | | |
| Emulsion B | silver amount: | 0.20 g |
| Emulsion C | silver amount: | 0.30 g |
| Gelatin | | 0.80 g |
| Coupler C-1 | | 0.10 g |
| Coupler C-2 | | 0.05 g |
| Coupler C-3 | | 0.02 g |
| High Boiling Point Organic Solvent Oil-2 | | 0.10 g |
| High Boiling Point Organic Solvent Oil-1 | | 0.05 g |
| Additive P-1 | | 0.10 g |
| Sixth Layer: High Sensitivity Red-Sensitive Emulsion Layer | | |
| Emulsion D | silver amount: | 0.40 g |
| Gelatin | | 1.10 g |
| Coupler C-1 | | 0.20 g |
| Coupler C-2 | | 0.10 g |
| Coupler C-3 | | 0.50 g |
| Additive P-1 | | 0.10 g |
| Seventh Layer: Interlayer | | |
| Gelatin | | 0.70 g |
| Additive M-1 | | 0.30 g |
| Compound Cpd-I | | 2.6 mg |
| Dye D-5 | | 0.020 g |
| Dye D-6 | | 0.010 g |

-continued

| | | |
|---|---|---|
| Compound Cpd-J | | 5.0 mg |
| High Boiling Point Organic Solvent Oil-1 | | 0.020 g |
| Eighth Layer: Interlayer | | |
| Surface and Interior Fogged Silver Iodobromide Emulsion (average grain size: 0.06 μm, variation coefficient: 16%, AgI content: 0.3 mol %) | silver amount: | 0.020 g |
| Yellow Colloidal Silver | silver amount: | 0.020 g |
| Gelatin | | 1.00 g |
| Additive P-1 | | 0.05 g |
| Color Mixing Preventive Cpd-A | | 0.10 g |
| High Boiling Point Organic Solvent Oil-3 | | 0.10 g |
| Ninth Layer: Low Sensitivity Green-Sensitive Emulsion Layer | | |
| Emulsion E | silver amount: | 0.10 g |
| Emulsion F | silver amount: | 0.20 g |
| Emulsion G | silver amount: | 0.20 g |
| Gelatin | | 0.50 g |
| Coupler C-4 | | 0.10 g |
| Coupler C-7 | | 0.050 g |
| Coupler C-8 | | 0.10 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-L | | 0.02 g |
| High Boiling Point Organic Solvent Oil-1 | | 0.10 g |
| High Boiling Point Organic Solvent Oil-2 | | 0.10 g |
| Tenth Layer: Middle Sensitivity Green-Sensitive Emulsion Layer | | |
| Emulsion G | silver amount: | 0.30 g |
| Emulsion H | silver amount: | 0.10 g |
| Gelatin | | 0.60 g |
| Coupler C-4 | | 0.070 g |
| Coupler C-7 | | 0.050 g |
| Coupler C-8 | | 0.050 g |
| Compound Cpd-B | | 0.030 g |
| Compound Cpd-D | | 0.020 g |
| Compound Cpd-E | | 0.020 g |
| Compound Cpd-F | | 0.050 g |
| High Boiling Point Organic Solvent Oil-2 | | 0.010 g |
| Eleventh Layer: High Sensitivity Green-Sensitive Emulsion Layer | | |
| Emulsion I | silver amount: | 0.50 g |
| Gelatin | | 1.00 g |
| Coupler C-4 | | 0.20 g |
| Coupler C-7 | | 0.10 g |
| Coupler C-8 | | 0.050 g |
| Compound Cpd-B | | 0.080 g |
| Compound Cpd-E | | 0.020 g |
| Compound Cpd-F | | 0.040 g |
| Compound Cpd-K | | 5.0 mg |
| High Boiling Point Organic Solvent Oil-1 | | 0.020 g |
| High Boiling Point Organic Solvent Oil-2 | | 0.020 g |
| Twelfth Layer: Interlayer | | |
| Gelatin | | 0.60 g |
| Compound Cpd-L | | 0.05 g |
| High Boiling Point Organic Solvent Oil-1 | | 0.05 g |
| Thirteenth Layer: Yellow Filter Layer | | |
| Yellow Colloidal Silver | silver amount: | 0.010 g |
| Gelatin | | 1.10 g |
| Color Mixing Preventive Cpd-A | | 0.10 g |
| High Boiling Point Organic Solvent Oil-3 | | 0.05 g |
| Microcrystal Solid Dispersion of Dye E-2 | | 0.030 g |
| Microcrystal Solid Dispersion of Dye E-3 | | 0.020 g |
| Fourteenth Layer: Interlayer | | |
| Gelatin | | 0.60 g |
| Fifteenth Layer: Low Sensitivity Blue-Sensitive Emulsion Layer | | |
| Emulsion J | silver amount: | 0.20 g |

-continued

| | | |
|---|---|---|
| Emulsion K | silver amount: | 0.30 g |
| Gelatin | | 0.80 g |
| Coupler C-5 | | 0.20 g |
| Coupler C-6 | | 0.10 g |
| Coupler C-10 | | 0.40 g |
| Compound Cpd-1 | | 0.02 g |
| Sixteenth Layer: Middle Sensitivity Blue-Sensitive Emulsion Layer | | |
| Emulsion L | silver amount: | 0.30 g |
| Emulsion M | silver amount: | 0.30 g |
| Gelatin | | 0.90 g |
| Coupler C-5 | | 0.10 g |
| Coupler C-6 | | 0.10 g |
| Coupler C-10 | | 0.60 g |
| Seventeenth Layer: High Sensitivity Blue-sensitive Emulsion Layer | | |
| Emulsion N | silver amount: | 0.20 g |
| Emulsion O | silver amount: | 0.20 g |
| Gelatin | | 1.20 g |
| Coupler C-5 | | 0.10 g |
| Coupler C-6 | | 0.10 g |
| Coupler C-10 | | 0.60 g |
| High Boiling Point Organic Solvent Oil-2 | | 0.10 g |
| Eighteenth Layer: First Protective Layer | | |
| Gelatin | | 0.70 g |
| Ultraviolet Absorbing Agent U-1 | | 0.20 g |
| Ultraviolet Absorbing Agent U-2 | | 0.050 g |
| Ultraviolet Absorbing Agent U-5 | | 0.30 g |
| Color Mixing Preventive Cpd-A | | 0.10 g |
| Formalin Scavenger Cpd-H | | 0.40 g |
| Dye D-1 | | 0.15 g |
| Dye D-2 | | 0.050 g |
| Dye D-3 | | 0.10 g |
| High Boiling Point Organic Solvent Oil-3 | | 0.10 g |
| Nineteenth Layer: Second Protective Layer | | |
| Colloidal Silver | silver amount: | 0.10 mg |
| Fine Grain Silver Iodobromide Emulsion (average grain size: 0.06 μm, AgI content: 1 mol %) | silver amount: | 0.10 g |
| Gelatin | | 0.40 g |
| Twentieth Layer: Third Protective Layer | | |
| Gelatin | | 0.40 g |
| Polymethyl Methacrylate (average particle size: 1.5 μm) | | 0.10 g |
| Copolymer of Methyl Methacrylate/Acrylic Acid in Proportion of 4/6 (average particle size: 1.5 μm) | 0.10 | g |
| Silicone Oil | | 0.030 g |
| Surfactant W-1 | | 3.0 mg |
| Surfactant W-2 | | 0.030 g |

Further, Additives F-1 to F-8 were added to every emulsion layer in addition to the above components. Moreover, gelatin hardener H-1 and surfactants W-3, W-4, W-5 and W-6 for coating and emulsifying were added to every layer in addition to the above components.

In addition, phenol, 1,2-benzisothiazolin-3-one, 2-phenoxyethanol, phenethyl alcohol, p-benzoic acid butyl ester were added as antibacterial and antifungal agents.

The silver iodobromide emulsions used in Sample No. 101 are as shown in Table 1.

TABLE 1

| Emulsion Name | Characteristics of Grain | Average Grain Size Corresponding to Sphere | Variation Coefficient (%) | AgI Content (%) |
|---|---|---|---|---|
| A | Monodisperse tetradecahedral grains | 0.28 | 16 | 4.0 |
| B | Monodisperse cubic internal latent image type grains | 0.30 | 10 | 4.0 |
| C | Monodisperse cubic grains | 0.38 | 10 | 5.0 |
| D | Monodisperse tabular grains, average aspect ratio: 3.0 | 0.68 | 8 | 2.0 |
| E | Monodisperse cubic grains | 0.20 | 17 | 4.0 |
| F | Monodisperse tetradecahedral grains | 0.25 | 16 | 4.0 |
| G | Monodisperse cubic internal latent image type grains | 0.40 | 11 | 4.0 |
| H | Monodisperse cubic grains | 0.50 | 9 | 3.5 |
| I | Monodisperse tabular grains, average aspect ratio: 5.0 | 0.80 | 10 | 2.0 |
| J | Monodisperse cubic grains | 0.30 | 18 | 4.0 |
| K | Monodisperse tetradecahedral grains | 0.45 | 17 | 4.0 |
| L | Monodisperse tabular grains, average aspect ratio: 5.0 | 0.55 | 10 | 2.0 |
| M | Monodisperse tabular grains, average aspect ratio: 8.0 | 0.70 | 13 | 2.0 |
| N | Monodisperse tabular grains, average aspect ratio: 6.0 | 1.00 | 10 | 1.5 |
| O | Monodisperse tabular grains, average aspect ratio: 9.0 | 1.20 | 15 | 1.5 |

TABLE 2

Spectral Sensitization of Emulsions A to I

| Emulsion Name | Sensitizing Dye Added | Addition Amount per mol of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |

TABLE 3

Spectral Sensitization of Emulsions J to O

| Emulsion Name | Sensitizing Dye Added | Addition Amount per mol of Silver Halide (g) |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

C-1
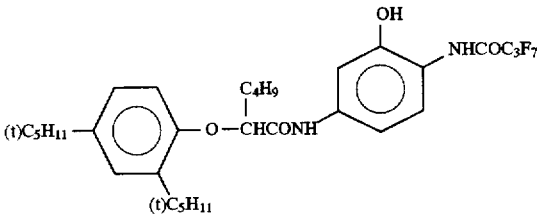
C-2
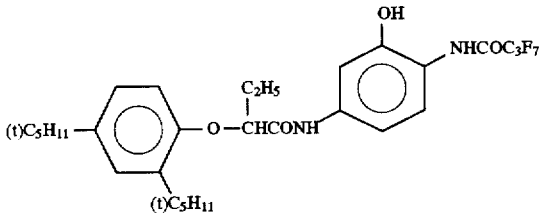
C-3
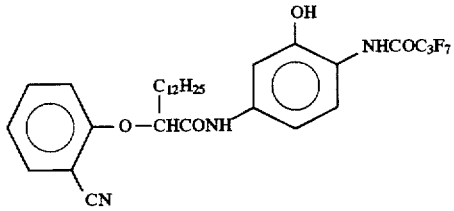
C-4
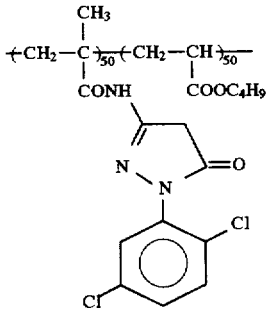
numerals indicate wt %
average molecular weight:
about 25,000
C-5
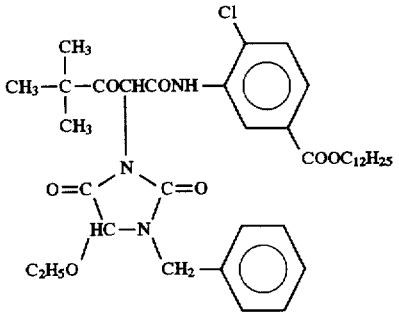
C-6
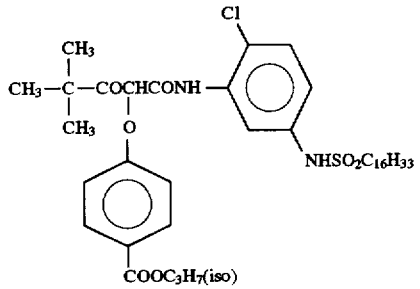

-continued
C-7
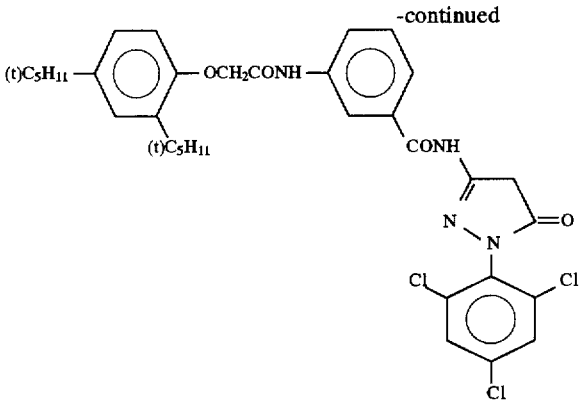
C-8
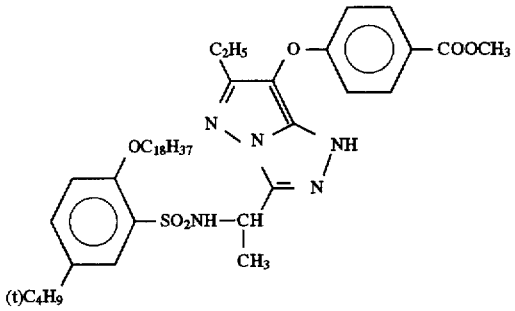
C-9
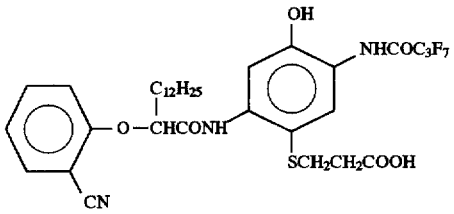
C-10
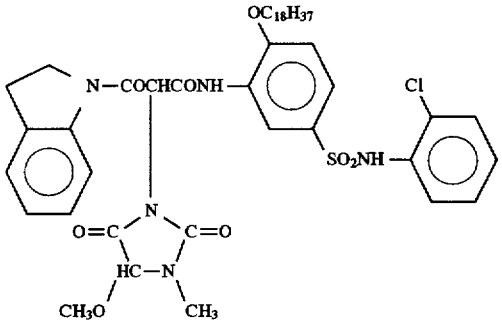
Dibutyl Phthalate — Oil-1
Tricresyl Phosphate — Oil-2
Oil-3
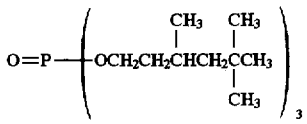
Cpd-A
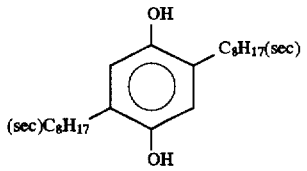

-continued
Cpd-B
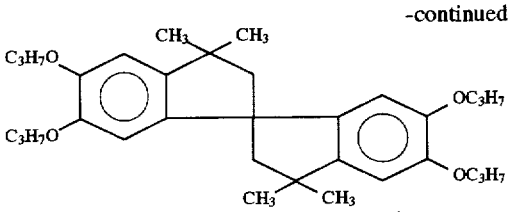
Cpd-C
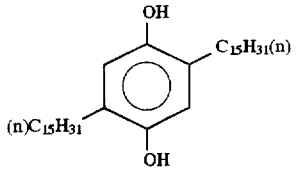
Cpd-D
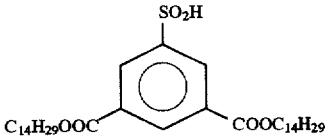
Cpd-E
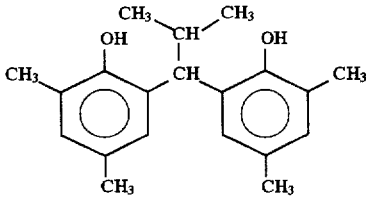
Cpd-F
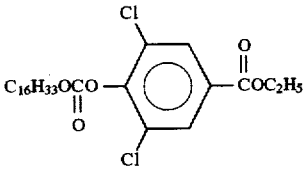
Cpd-H
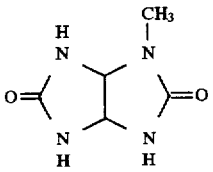
Cpd-I
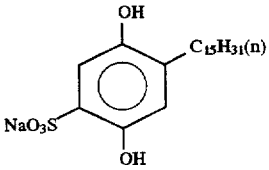
Cpd-J
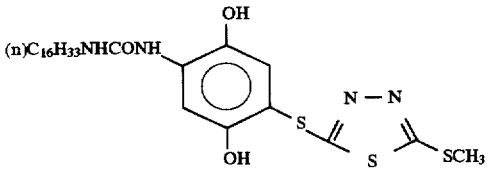
Cpd-K
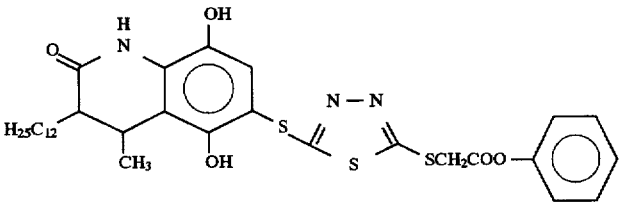

-continued
Cpd-L
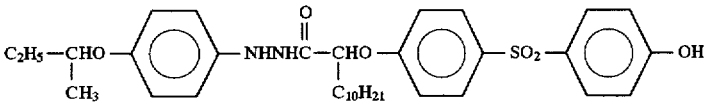
U-1
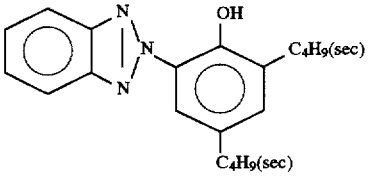
U-2
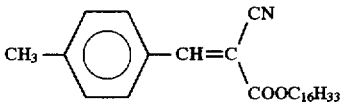
U-3
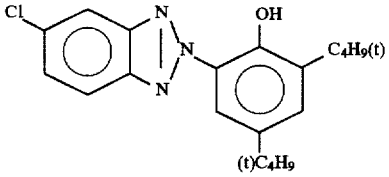
U-4
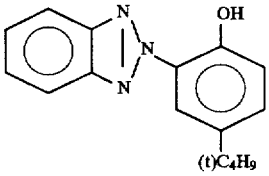
U-5
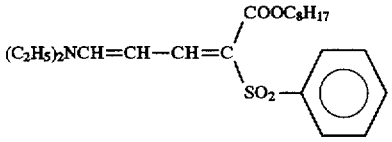
S-1
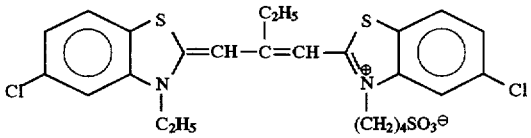
S-2
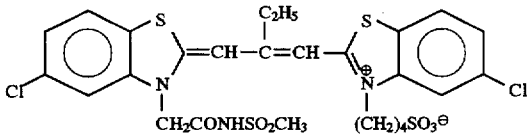
S-3
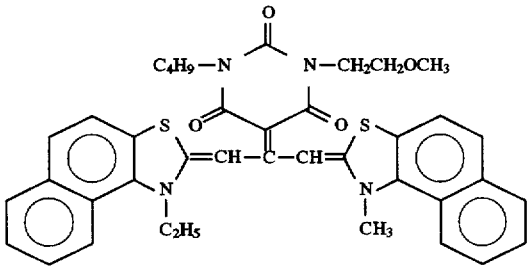
S-4
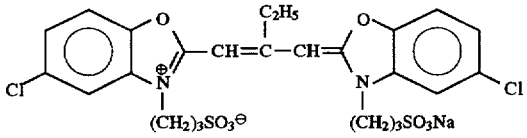

-continued
S-5
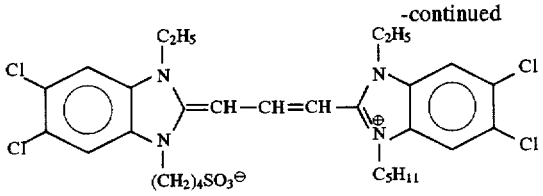
S-6
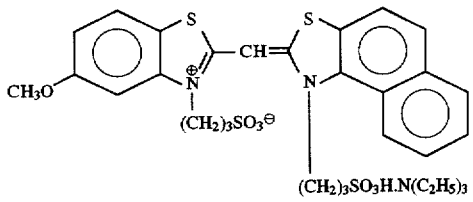
S-7
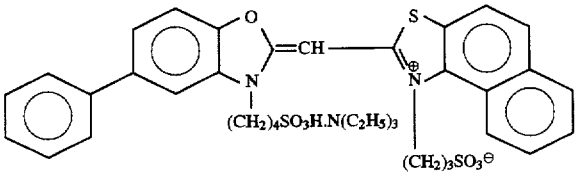
S-8
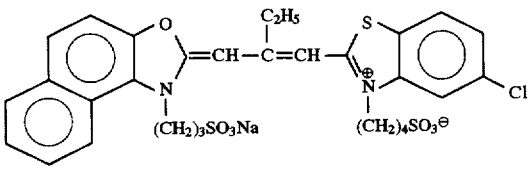
S-9
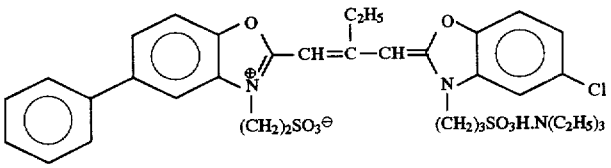
D-1
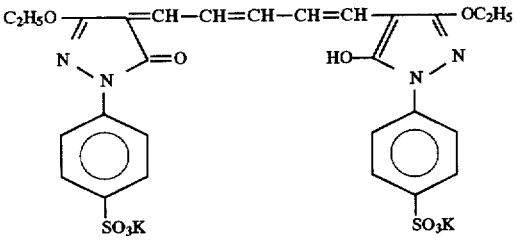
D-2
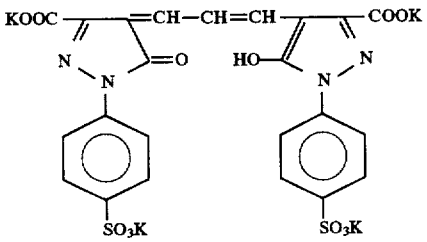
D-3
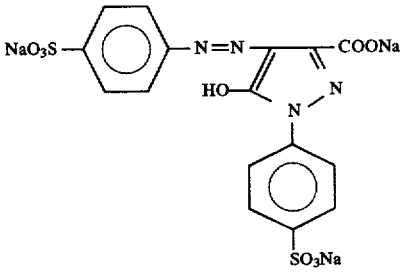

-continued
D-4
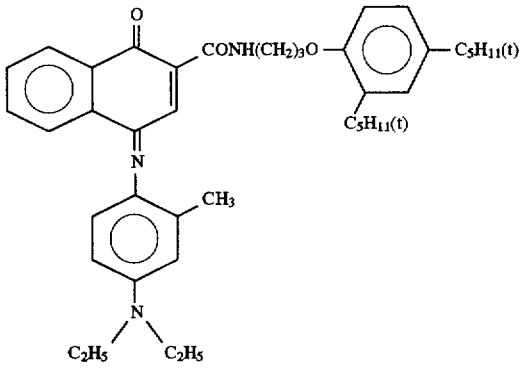
D-5
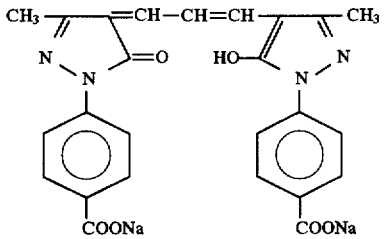
D-6
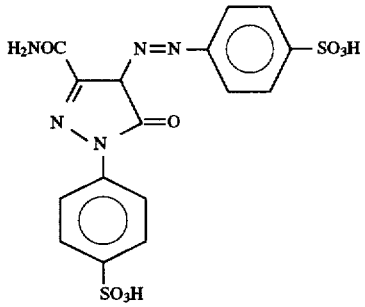
E-1
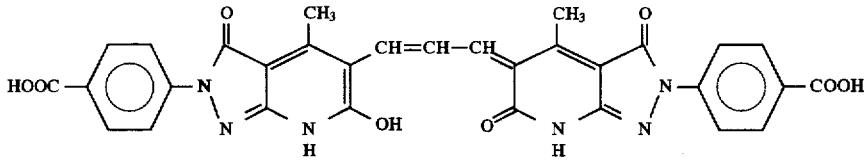
E-2
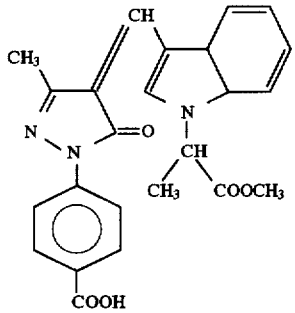
E-3
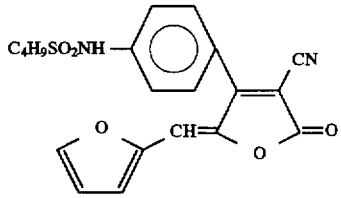

-continued
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
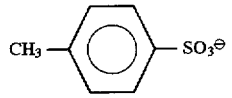
W-2
$C_8F_{17}SO_2HCH_2COOK$
$C_3H_7$
W-3
$CH_2COOCH_2CH(C_2H_5)C_4H_9$
$NaO_3S{-}CHCOOCH_2CH(C_2H_5)C_4H_9$
W-4
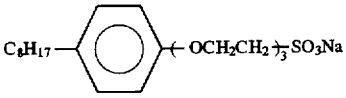
W-5
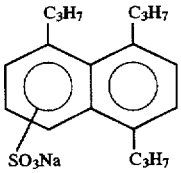
W-6
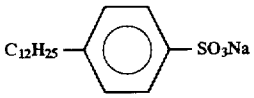
P-1
$(CH_2{-}CH)_n$
$CONHC_4H_9(t)$
M-1
$(CH_2{-}CH)_n$
$COOC_4H_9$
F-1
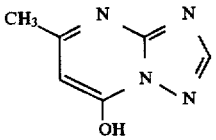
F-2
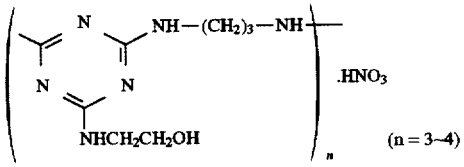
(n = 3–4)
F-3
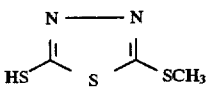
F-4
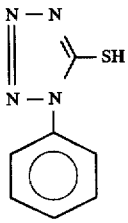

-continued

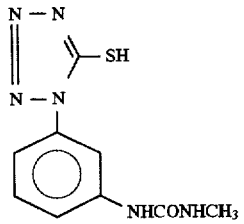

F-5

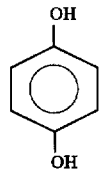

F-6

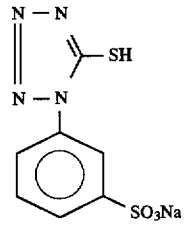

F-7

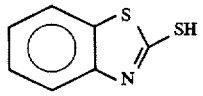

F-8

Preparation of Dispersion of Organic Solid Dispersion Dye

Dye E-1 was dispersed according to the following method. That is, water and 200 g of Pluronic F88 (ethylene oxide/propylene oxide block copolymer) manufactured by BASF Co. were added to 1,430 g of a wet cake of the dye containing 30% of methanol, and stirred to obtain a slurry having 6% dye concentration. Next, 1,700 ml of zirconia beads having an average diameter of 0.5 mm were filled in an ultravisco mill (UVM-2) manufactured by Imex Co., the slurry was passed and the content was pulverized at a peripheral speed of about 10 m/sec and discharge amount of 0.5 l/min for 8 hours. Beads were removed by filtration, water was added to dilute the dispersion to dye concentration of 3%, then heated at 90° C. for 10 hours for stabilization. The average grain size of the obtained fine grains of the dye was 0.60 μm and the extent of distribution of grain sizes (standard deviation of grain sizes×100/average grain size) was 18%.

Solid dispersions of Dye E-2 and E-3 were obtained in the same manner. The average grain sizes of fine grains of the dyes were 0.54 μm and 0.56 μm, respectively.

Sample Nos. 102 to 114 were prepared in the same manner as the preparation of Sample No. 101, except for changing the third to seventh layers of Sample No. 101 as shown in Table 4. Moreover, emulsions, high boiling point organic solvents and gelatins which were not described in column of Sample No. 101 in Table 4 were not changed from Sample No. 101.

Interlayer A was coated between the fourth layer and the fifth layer and interlayer B was coated between the fifth layer and the sixth layer and the basic composition of interlayer A or B was as follows.

Interlayer A or B:

Gelatin 0.50 g

High Boiling Point Organic Solvent Oil-1 0.10 g

Further, the compound shown in Table 4 were added. (Provided that surfactants were used as in other layers.)

TABLE 4

Constitution of Samples (blanks mean there were made no change from Sample No. 101)

| Sample No. | 101 (Comparison) | 102 (Comparison) | 103 (Comparison) | 104 (Invention) | 105 (Comparison) | 106 (Invention) | 107 (Invention) |
|---|---|---|---|---|---|---|---|
| 7th Layer | | | | Cpd-A 0.10 g (additionally added) | | | |
| 6th Layer | Coupler C-1 0.20 g Coupler C-2 0.10 g Coupler C-3 0.50 g | (5) 0.40 g | (5) 0.40 g | (5) 0.40 g | (5) 0.40 g | (5) 0.40 g | (5) 0.40 g |
| Interlayer B | Not provided | Not provided | Not provided | Cpd-A 0.10 g | Not provided | Not provided | Q-3 0.16 g |

TABLE 4-continued

| Constitution of Samples (blanks mean there were made no change from Sample No. 101) | | | | | | | |
|---|---|---|---|---|---|---|---|
| 5th Layer | Coupler C-1 0.10 g Coupler C-2 0.05 g Coupler C-3 0.02 g | (5) 0.08 g | (5) 0.08 g Cpd-A 0.04 g | (5) 0.08 g | (5) 0.08 g Cpd-L 0.09 g | (5) 0.08 g Q-3 0.08 g | (5) 0.08 g |
| Interlayer A | Not provided | Not provided | Not provided | Cpd-A 0.10 g | Not provided | Not provided | Q-3 0.16 g |
| 4th Layer | Coupler C-1 0.10 g Coupler C-2 0.10 g | (5) 0.10 g | (5) 0.10 g Cpd-A 0.05 g | (5) 0.10 g | (5) 0.10 g Cpd-L 0.12 g | (5) 0.10 g Q-3 0.10 g | (5) 0.10 g |
| 3rd Layer | | | | Cpd-A 0.10 g (additionally added) | | | |

| Sample No. | 108 (Invention) | 109 (Comparison) | 110 (Invention) | 111 (Invention) | 112 (Invention) | 113 (Invention) | 114 (Invention) |
|---|---|---|---|---|---|---|---|
| 7th Layer | | | | | | WC-2 0.10 g | WC-5 0.06 g |
| 6th Layer | (35) 0.42 g | ExC-1 0.36 g | (3) 0.38 g | (13) 0.42 g Q-5 0.10 g | (39) 0.36 g | (39) 0.36 g | (5) 0.38 g |
| Interlayer B | Not provided | Not provided | Not provided | Not provided | WC-2 0.10 g | Not provided | Not provided |
| 5th Layer | (35) 0.10 g Q-5 0.10 g | ExC-1 0.08 g Q-5 0.10 g | (13) 0.08 g SC-2 0.10 g | (13) 0.10 g SC-19 0.12 g | (13) 0.10 g Q-23 0.05 g | (13) 0.10 g Q-5 0.10 g | (13) 0.12 g WC-5 0.10 g |
| Interlayer A | Not provided | Not provided | Not provided | Not provided | WC-2 0.10 g | Not provided | Coated only gelatin |
| 4th Layer | (5) 0.10 g Q-5 0.08 g | ExC-1 0.08 g Q-5 0.08 g | (13) 0.10 g SC-2 0.12 g | (13) 0.10 g SC-19 0.16 g | (13) 0.10 g Q-23 0.10 g | (13) 0.10 g | (13) 0.12 g WC-5 0.08 g |
| 3rd Layer | | | | | WC-2 0.05 g | Q-5 0.15 g | Q-5 0.10 g |

ExC-1

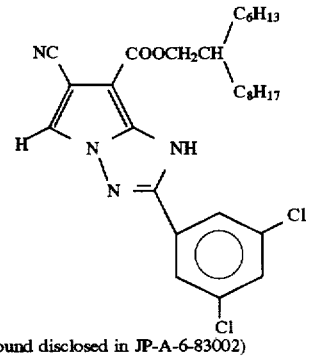

(Compound disclosed in JP-A-6-83002)

Evaluation of Graininess

After the thus-obtaiend sample Nos. 101 to 114 were subjected to step wedge exposure, development processed as described below and RMS granularity of cyan image was measured. Measurement was conducted using an aperture of 48 μmϕ and showed in the value obtained by multiplying the measured value by 1,000.

Evaluation of Color Reproducibility

Color reproducibility was evaluated by photographing color checker chart of Macbeth using Sample Nos. 101 to 114. When photographing, color balance was adjusted using a color filter with every sample and evaluation was conducted by five examiners who participated in image evaluation in Ashigara Laboratory of Fuji Photo Film Co., Ltd. by marking less turbidity and higher chroma of green and bluish green as a higher mark with 5 points per one examiner being upper limit and evaluated by the obtained marks out of total of 25 marks of five examiners.

Evaluation of Raw Stock Storability

Sample Nos. 101 to 114 stored under the condition of 50° C., 70% RH for one month and those under 25° C., 50% RH for the same period of time were exposed to white light of 4,800° K. through a continuous wedge, then each sample was development processed in the same manner and cyan density was measured, and the change in sensitivity $\Delta S_R$ at the point giving cyan density of 1.0 was found out. Sensitivity change was shown with the value of the higher sensitivity being a direction of positive.

The results of evaluations obtained are shown in Table 5.

TABLE 5

Results of Evaluation

| Sample No. | Remarks | Graininess (RMS × 1,000) Density 0.5 | Density 1.0 | Storability $\Delta S_R$ | Color Reproducibility (on the basis of 25 points) |
|---|---|---|---|---|---|
| 101 | Comparison | 7.0 | 10.5 | 0.04 | 13 |
| 102 | Comparison | 9.0 | 11.5 | 0.03 | 19 |
| 103 | Comparison | 9.0 | 12.5 | 0.12 | 18 |
| 104 | Invention | 7.0 | 10.5 | 0.08 | 22 |
| 105 | Comparison | 8.5 | 11.0 | 0.05 | 20 |
| 106 | Invention | 7.0 | 10.5 | 0.04 | 24 |
| 107 | Invention | 6.5 | 9.0 | 0.03 | 23 |

TABLE 5-continued

| Sample No. | Remarks | Results of Evaluation: Graininess (RMS × 1,000) Density 0.5 | Density 1.0 | Storability $\Delta S_R$ | Color Reproducibility (on the basis of 25 points) |
|---|---|---|---|---|---|
| 108 | Invention | 7.0 | 10.0 | 0.03 | 24 |
| 109 | Comparison | 9.5 | 12.0 | 0.07 | 20 |
| 110 | Invention | 7.0 | 10.5 | 0.02 | 23 |
| 111 | Invention | 7.5 | 10.5 | 0.03 | 24 |
| 112 | Invention | 6.5 | 9.0 | 0.04 | 23 |
| 113 | Invention | 7.0 | 10.0 | 0.04 | 23 |
| 114 | Invention | 6.5 | 9.5 | 0.04 | 24 |

As shown in Table 5, Sample Nos. 102 to 114 in which pyrroloazole couplers were used were improved in color reproducibility of green and bluish green compared with Sample No. 101 in which phenol cyan couplers were used. Further, Sample No. 102 in which competitive compounds were not used deteriorated in graininess, on the contrary, the graininess of the samples of the present invention were improved and showed good graininess compared with Sample Nos. 103, 105 and 109. The effect of improving graininess was larger in Sample No. 104 in which interlayers A and B were provided than Sample No. 103 in which the same compounds were used in emulsion layers, and the improving effect of graininess was particularly large in Sample Nos. 107 and 112 in which competitive compounds for use in the present invention were added to interlayer A or B.

In Sample No. 103 in which hydroquinone compounds were added to light-sensitive emulsion layers or interlayers, the sensitivity during storage of the photographic material was largely deteriorated but such undesired effect was not seen in the combination of the present invention. As stated above, the present invention can provide a photographic material excellent in color reproducibility, graininess and raw stock storability by the combination of the present invention using pyrroloazole couplers having better hue than that of phenol couplers.

Development processing was conducted as follows.

| Processing Step | Processing Time (min) | Processing Temperature (°C.) | Tank Capacity (liter) | Replenishment Rate (ml/m²) |
|---|---|---|---|---|
| First Development | 6 | 38 | 12 | 2,200 |
| First Washing | 2 | 38 | 4 | 7,500 |
| Reversal | 2 | 38 | 4 | 1,100 |
| Color Development | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Second Washing | 4 | 38 | 8 | 7,500 |
| Final Rinsing | 1 | 25 | 2 | 1,100 |

The composition of each processing solution used was as follows.

| | Tank Solution | Replenisher |
|---|---|---|
| **First Developing Solution** | | |
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinone-monosulfonate | 20 g | 20 g |
| Potassium Carbonate | 15 g | 20 g |
| Sodium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1,000 ml | 1,000 ml |
| pH (adjusted with sulfuric acid or potassium hydroxide) | 9.60 | 9.60 |
| **Reversal Solution** | | |
| Pentasodium Nitrilo-N,N,N-trimethylenephosphonate | 3.0 g | same as the tank solution |
| Stannous Chloride Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| **Color Developing Solution** | | |
| Pentasodium Nitrilo-N,N,N-trimethylenephosphonate | 2.0 g | 2.0 g |
| Sodium Sulfite | 7.0 g | 7.0 g |
| Trisodium Phosphate Dodecahydrate | 36 g | 36 g |
| Potassium Bromide | 1.0 g | |
| Potassium Iodide | 90 mg | |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline.3/2 Sulfate. Monohydrate | 11 g | 11 g |
| 3,6-Dithiaoctane-1,8-diol | 1.0 g | 1.0 g |
| Water to make | 1,000 ml | 1,000 ml |
| pH (adjusted with sulfuric acid or potassium hydroxide) | 11.80 | 12.00 |
| **Pre-bleaching Solution** | | |
| Disodium Ethylenediaminetetraacetate Dihydrate | 8.0 g | 8.0 g |
| Sodium Sulfite | 6.0 g | 8.0 g |
| 1-Thioglycerol | 0.4 g | 0.4 g |
| Sodium Bisulfite Addition Products of Formaldehyde | 30 g | 35 g |
| Water to make | 1,000 ml | 1,000 ml |
| pH (adjusted with acetic or sodium hydroxide) | 6.30 | 6.10 |
| **Bleaching Solution** | | |
| Disodium Ethylenediaminetetraacetate Dihydrate | 2.0 g | 4.0 g |
| Ammonium Ethylenediaminetetraacetato Ferrate Dihydrate | 120 g | 240 g |
| Potassium Bromide | 100 g | 200 g |
| Ammonium Nitrate | 10 g | 20 g |
| Water to make | 1,000 ml | 1,000 ml |
| pH (adjusted with nitric acid or sodium hydroxide) | 5.70 | 5.50 |
| **Fixing Solution** | | |
| Ammonium Thiosulfate | 80 g | same as the tank solution |
| Sodium Sulfite | 5.0 g | same as the tank solution |
| Sodium Bisulfite | 5.0 g | same as the tank solution |

-continued

| | Tank Solution | Replenisher |
|---|---|---|
| Water to make | 1,000 ml | same as the tank solution |
| pH (adjusted with acetic acid or aqueous ammonia) | 6.60 | |
| Stabilizing Solution | | |
| 1,2-Benzisothiazolin-3-one | 0.02 g | 0.03 g |
| Polyoxyethylene-p monononylphenyl Ether (average polymerization degree: 10) | 0.3 g | 0.3 g |
| Polymaleic Acid (average molecular weight: 2,000) | 0.1 g | 0.15 g |
| Water to make | 1,000 ml | 1,000 ml |
| pH | 7.0 | 7.0 |

EXAMPLE 2

1) Support

The support which was used in the present invention was prepared as follows.

One hundred weight parts of commercially available polyethylene-2,6-naphthalate polymer and 2 weight parts of Tinuvin P. 326 (a product of Ciba Geigy), as an ultraviolet absorbing agent, were dried in a usual method, then, melted at 300° C., subsequently extruded through a T-type die, and stretched 3.0 times in a machine direction at 140° C. and then 3.0 times in a transverse direction at 130° C., and further thermal fixed for 6 seconds at 250° C. and the PEN film having the thickness of 90 μm was obtained.

Further, a part of the film was wound on to a stainless steel spool having a diameter of 20 cm and provided heat history at 110° C. for 48 hours.

2) Coating of undercoat layer

An undercoat layer having the following composition was coated on one side of the above support after both surfaces of which were subjected to corona discharge, UV discharge, further, glow discharge and flame discharge treatments. The undercoat layer was provided on the hotter side at the time of stretching. The corona discharge treatment was carried out using solid state corona processor model 6KVA model available from Pillar Co., Ltd. which can treat the support of 30 cm wide at a rate of 20 m/min. At this time, the treatment of 0.375 KV·A·min/$m^2$ was conducted to the support from the reading of the electric current and voltage. The discharge frequency at the treatment time was 9.6 KHz, gap clearance between the electrode and the induction roll was 1.6 mm. UV discharge treatment was conducted by heating at 75° C. Further, glow discharge treatment was conducted by a cylindrical electrode at 3,000 W and irradiated for 30 sec.

| | |
|---|---|
| Gelatin | 3 g |
| Distilled Water | 25 ml |
| Sodium-α-sulfo-di-2-ethylhexyl-succinate | 0.05 g |
| Formaldehyde | 0.02 g |
| Salicylic Acid | 0.1 g |
| Diacetyl Cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Trimethylolpropane Aziridine 3 Time Mol Addition Product | 0.2 g |
| Trimethylolpropane-Toluene-diisocyanate 3 Time Mol Addition Product | 0.2 g |
| Methanol | 15 ml |
| Acetone | 85 ml |
| Formaldehyde | 0.01 g |
| Acetic Acid | 0.01 g |
| Concentrated Hydrochloric Acid | 0.01 g |

3) Coating of backing layer

On one side of the above support on which no undercoat layer was coated after undercoat layer coating, an antistatic layer, a magnetic recording layer and a sliding layer having the following compositions were coated as backing layers.

3-1) Coating of antistatic layer 3-1-1) Preparation of electrically conductive fine grain dispersion solution (a composite dispersion solution of stannic oxide-antimony oxide)

230 weight parts of stannic chloride hydrate and 23 weight parts of antimony trichloride were dissolved in 3,000 weight parts of ethanol and homogeneous solution was obtained. A 1N aqueous sodium hydroxide solution was dropwise added to the above solution until the pH of the solution reached 3, thereby the coprecipitate of colloidal stannic oxide and antimony oxide was obtained. The thus-obtained coprecipitate was allowed to stand at 50° C. for 24 hours and red brown colloidal precipitate was obtained.

The red brown colloidal precipitate was isolated by a centrifugal separator. Water was added to the precipitate and washed by centrifugation to remove excessive ions. The excessive ions were removed by performing this operation three times.

200 weight parts of the colloidal precipitate from which the excessive ions were removed was again dispersed in 1,500 weight parts of water, atomized in a kiln heated to 650° C., thereby a bluish fine grain powder of a stannic oxide-antimony oxide composite having an average grain size of 0.005 μm was obtained. The specific resistance of this fine grain powder was 5 Ω·cm.

The pH of the mixed solution comprising 40 weight parts of the above fine grain powder and 60 weight parts of water was adjusted to 7.0. This mixed solution was dispersed coarsely by a stirrer, then dispersed using a horizontal sand mill (Dyno Mill, manufactured by WILLYA. BACHOFENAG) until the residence time reached 30 minutes, thus the objective product was prepared. The average grain size of the second agglomerate was about 0.04 μm.

3-1-2) Coating of an electrically conductive layer

The electrically conductive layer having the following formulation was coated on the support so as to the dry film thickness reached 0.2 μm and dried at 115° C. for 60 seconds.

| | |
|---|---|
| Electrically Conductive Fine Grain Dispersion Solution prepared in 3-1-1) | 20 weight parts |
| Gelatin | 2 weight parts |
| Water | 27 weight parts |
| Methanol | 60 weight parts |
| p-Chlorophenol | 0.5 weight part |
| Resorcin | 2 weight parts |
| Polyoxyethylenenonylphenyl Ether | 0.01 weight part |

The resistance of the electrically conductive film obtained was $10^{8.0}$ Ω (100 V) and this showed excellent antistatic property.

3-2) Coating of magnetic recording layer

To 1,100 g of magnetic substance Co-adherend γ-$Fe_2O_3$ (acicular, major axis: 0.14 μm, minor axis: 0.03 μm, specific surface area: 41 $m^2/g$, saturation magnetization: 89 emu/g, the surface was surface treated with 2 wt %, respectively, based on $Fe_2O_3$, of aluminum oxide and silicon oxide, coercive force: 930 Oe, $Fe^{+2}/Fe^{+3}$ is 6/94), 220 g of water and 150 g of silane coupling agent of poly(polymerization degree: 16)-oxyethylenepropyltrimethoxysilane were added and kneaded well in an open kneader for 3 hours. This coarsely dispersed viscous solution was dried at 70° C. a whole day and night and the water was removed, and heated at 110° C. for 1 hour to prepare the surface-treated magnetic grains.

Further, this product was again kneaded in the open kneader according to the following formulation.

| | |
|---|---|
| The Above Surface-Treated Magnetic Grain | 1,000 g |
| Diacetyl Cellulose | 17 g |
| Methyl Ethyl Ketone | 100 g |
| Cyclohexanone | 100 g |

Further, this product was finely dispersed by a sand mill (¼ G) at 200 rpm for 4 hours according to the following formulation.

| | |
|---|---|
| The Above Kneaded Product | 100 g |
| Diacetyl Cellulose | 60 g |
| Methyl Ethyl Ketone | 300 g |
| Cyclohexanone | 300 g |

Further, diacetyl cellulose and trimethylolpropanetoluenediisocyanate 3 time mol addition product as a hardening agent were added thereto in an amount of 20 wt % based on the binder. This was diluted with equal amounts of methyl ethyl ketone and cyclohexanone so that the viscosity of the obtained solution became about 80 cp. The solution was coated on the above electrically conductive layer using a bar coater so that the film thickness became 1.2 μm. The magnetic substance was coated in an amount of 62 $mg/m^2$. As matting agents, silica grains (0.3 pm) and aluminum oxide abrasive (0.5 μm) were added each in an amount of 10 $mg/m^2$. Drying was conducted at 115° C. for 6 min (the temperature of the roller and transporting apparatus of the drying zone was 115° C.).

The increase of the color density of $D^B$ of the magnetic recording layer was about 0.1 when a blue filter was used at status M of X-light. Saturation magnetization moment of the magnetic recording layer was 4.2 $emu/m^2$, coercive force was 923 Oe, and rectangular ratio was 65%.

3-3) Preparation of sliding layer

A sliding layer was prepared by coating the following composition on the support so that the coating amount of the solid part of the compound became the following amounts, and dried at 110° C. for 5 min to prepare a sliding layer.

| | |
|---|---|
| Diacetyl Cellulose | 25 $mg/m^2$ |
| $C_6H_{13}CH(OH)C_{10}H_{20}COOC_{40}H_{81}$ (Compound a) | 6 $mg/m^2$ |
| $C_{50}H_{101}O(CH_2CH_2O)_{16}H$ (Compound b) | 9 $mg/m^2$ |

Compound a/Compound b (6/9) were dissolved in xylylene and propylene glycol monomethyl ether solvent (volume ratio: 1/1) by heating at 105° C., and this solution was poured into 10 time amount of propylene glycol monomethyl ether (25° C.) and finely dispersed. This solution was further diluted in 5 time amount of acetone, dispersed again using a high pressure homogenizer (200 atm.) and the obtained dispersion (average grain size: 0.01 μm) was added to the coating solution. The obtained sliding layer showed excellent capacities of dynamic friction coefficient: 0.06 (a stainless steel hard ball of 5 mmϕ, load: 100 g, speed: 6 cm/min), static friction coefficient: 0.07 (clip method). The sliding property with the surface of the emulsion described above provided dynamic friction coefficient of 0.12.

4) Coating of a light-sensitive layer

Next, each layer having the same composition as Sample Nos. 101 to 114 in Example 1 was multilayer coated on the opposite side of the above obtained backing layer and Sample Nos. 201 to 214 were prepared.

Sample Nos. 201 to 214 were exposed and development processed in the same manner as in Example 1, the results obtained were the same as in Example 1.

EXAMPLE 3

Sample Nos. 302 to 314 were prepared by replacing Cp-B and Cp-C in the third and fourth layers in Example 2 of JP-A-2-90151 with 50 mol% of pyrroloazole couplers similarly as in the preparation of Sample Nos. 102 to 114 of the present invention. Provided that interlayer A was provided between the third layer and the fourth layer and interlayer B was not provided. After Sample Nos. 302 to 314 thus obtained were exposed, development processed as described in JP-A-2-90151, the results obtained were the same as in Example 1.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having provided thereon at least one blue-sensitive silver halide emulsion layer, at least one green-sensitive silver halide emulsion layer, and at least one red-sensitive silver halide emulsion layer, wherein at least one layer of said at least one red-sensitive silver halide emulsion layer contains at least one of the cyan couplers represented by the following formula (1), and at least one layer contains at least one compound selected from the compounds represented by the following formula (2) and the compounds which react with the oxidized product of an aromatic primary amine color developing agent but substantially do not form color images:

(1)

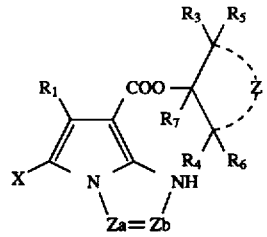

wherein Za represents —C($R_2$)= or —N=, when Za represents —N=, Zb represents —C($R_2$)= and when Za represents —C($R_2$)=, Zb represents —N=; $R_1$ represents an electron attractive group having a Hammett's substituent constant σp value of from 0.20 to 1.0; $R_2$ represents a substituent; X represents a hydrogen atom or a group separated upon coupling reaction with the oxidized product of an aromatic primary amine color developing agent; $R_3$ and $R_4$ each represents an aliphatic group; $R_5$, $R_6$ and $R_7$ each represents a hydrogen atom or an aliphatic group; and Z represents a non-metal atomic group necessary to form a saturated or unsaturated ring;

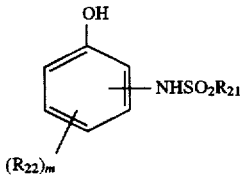

(2)

wherein $R_{21}$, represents an alkyl group or an aryl group which may be substituted; the substitution position of $NHSO_2R_{21}$ is the 2-position or 4-position of OH; $R_{22}$ represents a substituent; m represents 0 or an integer of 1, 2, 3 or 4, and when m is 2 or more, the plurality of $R_{22}$'s may be the same or different, they may be bonded with each other to form a saturated or unsaturated ring, or they may be bonded to polymer chain.

2. A silver halide color photographic material comprising a support having provided thereon at least one blue-sensitive silver halide emulsion layer, at least one green-sensitive silver halide emulsion layer, and at least one red-sensitive silver halide emulsion layer, wherein at least one layer of said at least one red-sensitive silver halide emulsion layer comprises a red-sensitive unit layer comprising at least two red-sensitive emulsion layers having different sensitivities, at least one layer of said at least two layers which constitute the red-sensitive unit layer contains at least one of the cyan couplers represented by the following formula (1), and an interlayer is provided between two red-sensitive emulsion layers in said red-sensitive layer unit so as to contact with the two red-sensitive emulsion layers at the same time:

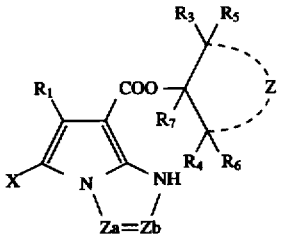

(1)

wherein Za represents —C($R_2$)= or —N=, when Za represents —N=, Zb represents —C($R_2$)= and when Za represents —C($R_2$)=, Zb represents —N=; $R_1$ represents an electron attractive group having a Hammett's substituent constant σp value of from 0.20 to 1.0; $R_2$ represents a substituent; X represents a hydrogen atom or a group separated upon coupling reaction with the oxidized product of an aromatic primary amine color developing agent; $R_3$ and $R_4$ each represents an aliphatic group; $R_5$, $R_6$ and $R_7$ each represents a hydrogen atom or an aliphatic group; and Z represents a non-metal atomic group necessary to form a saturated or unsaturated ring.

3. The silver halide color photographic material as claimed in claim 2, wherein the interlayer or the red-sensitive emulsion layer in said red-sensitive unit layer contains at least one compound selected from the compounds represented by the following formula (2) and compounds which react with the oxidized product of an aromatic primary amine color developing agent but substantially do not form color images:

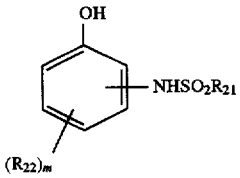

(2)

wherein $R_{21}$ represents an alkyl group or an aryl group which may be substituted; the substitution position of $NHSO_2R_{21}$ is the 2-position or 4-position of OH; $R_{22}$ represents a substituent; m represents 0 or an integer of 1, 2, 3 or 4, and when m is 2 or more, the plurality of $R_{22}$'s may be the same or different, they may be bonded with each other to form a saturated or unsaturated ring, or they may be bonded to polymer chain.

4. A method for forming images which comprises black-and-white development processing an imagewise exposed silver halide color photographic material and then processing with a color developing solution having pH of 11 or more, wherein the silver halide color photographic material before imagewise exposure is a silver halide color photographic material comprising a support having provided thereon at least one blue-sensitive silver halide emulsion layer, at least one green-sensitive silver halide emulsion layer, and at least one red-sensitive silver halide emulsion layer, wherein at least one layer of said at least one red-sensitive silver halide emulsion layer contains at least one of the cyan couplers represented by the following formula (1), and at least one layer contains at least one compound selected from the compounds represented by the following formula (2) and the compounds which react with the oxidized product of an aromatic primary amine color developing agent but substantially do not form color images:

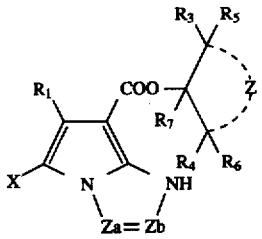

(1)

wherein Za represents —C($R_2$)= or —N=, when Za represents —N=, Zb represents —C($R_2$)= and when Za represents —C($R_2$)=, Zb represents —N=; $R_1$ represents an electron attractive group having a Hammett's substituent constant σp value of from 0.20 to 1.0; $R_2$ represents a substituent; X represents a hydrogen atom or a group separated upon coupling reaction with the oxidized product of an aromatic primary amine color developing agent; $R_3$ and $R_4$ each represents an aliphatic group; $R_5$, $R_6$ and $R_7$ each represents a hydrogen atom or an aliphatic group; and Z represents a non-metal atomic group necessary to form a saturated or unsaturated ring;

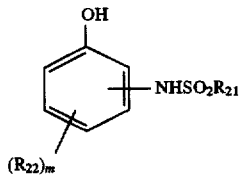

(2)

wherein $R_{21}$ represents an alkyl group or an aryl group which may be substituted; the substitution position of $NHSO_2R_{21}$ is the 2-position or 4-position of OH; $R_{22}$ represents a substituent; m represents 0 or an integer of 1, 2, 3 or 4, and when m is 2 or more, the plurality of $R_{22}$'s may be the same or different, they may be bonded with each other to form a saturated or unsaturated ring, or they may be bonded to polymer chain.

5. A method for forming images which comprises black-and-white development processing the imagewise exposed silver halide color photographic material and then processing with a color developing solution having pH of 11 or more, wherein the silver halide color photographic material before imagewise exposure is a silver halide color photographic material comprising a support having provided thereon at least one blue-sensitive silver halide emulsion layer, at least one green-sensitive silver halide emulsion layer, and at least one red-sensitive silver halide emulsion layer, wherein at least one layer of said at least one red-sensitive silver halide emulsion layer comprises a red-sensitive unit layer comprising at least two red-sensitive emulsion layers having different sensitivities, at least one layer of said at least two layers which constitute the red-sensitive unit layer contains at least one of the cyan couplers represented by the following formula (1), and an interlayer is provided between two red-sensitive emulsion layers in said red-sensitive layer unit so as to contact with the two red-sensitive emulsion layers at the same time:

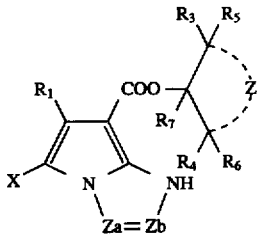

(1)

wherein Za represents —C($R_2$)= or —N=, when Za represents —N=, Zb represents —C($R_2$)= and when Za represents —C($R_2$)=, Zb represents —N=; $R_1$ represents an electron attractive group having a Hammett's substituent constant σp value of from 0.20 to 1.0; $R_2$ represents a substituent; X represents a hydrogen atom or a group separated upon coupling reaction with the oxidized product of an aromatic primary amine color developing agent; $R_3$ and $R_4$ each represents an aliphatic group; $R_5$, $R_6$ and $R_7$ each represents a hydrogen atom or an aliphatic group; and Z represents a non-metal atomic group necessary to form a saturated or unsaturated ring.

6. A method for forming images as claimed in claim 5, wherein the interlayer or the red-sensitive emulsion layer in said red-sensitive unit layer contains at least one compound selected from the compounds represented by the following formula (2) and compounds which react with the oxidized product of an aromatic primary amine color developing agent but substantially do not form color images:

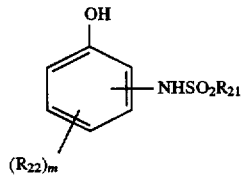

(2)

wherein $R_{21}$ represents an alkyl group or an aryl group which may be substituted; the substitution position of $NHSO_2R_{21}$ is the 2-position or 4-position of OH; $R_{22}$ represents a substituent; m represents 0 or an integer of 1, 2, 3 or 4, and when m is 2 or more, the plurality of $R_{22}$'s may be the same or different, they may be bonded with each other to form a saturated or unsaturated ring, or they may be bonded to polymer chain.

7. The silver halide color photographic material as claimed in claim 1, wherein said compounds which react with the oxidized product of an aromatic primary amine color developing agent but substantially do not form color images are couplers represented by the following formula (C-1):

A-B (C-1)

wherein A represents a group which is capable of coupling with the oxidized product of an aromatic primary amine color developing agent and from which a movable dye is formed by a coupling reaction, so that the dye does not color a photographic material processed, and B represents a group bonded to the coupling position of the group represented by A through an oxygen atom, a sulfur atom or a nitrogen atom, and necessary to fix the coupler represented by the formula (C-1) at a specific position in the photographic material during storage or processing.

8. The silver halide color photographic material as claimed in claim 7, wherein at least one layer of said at least one red-sensitive silver halide emulsion layer contains at least one of the cyan couplers represented by the formula (1) and the lowest sensitivity emulsion layer of said at least one red-sensitive silver halide emulsion layer or a layer directly adjacent thereto contains at least one of the couplers represented by the formula (C-1).

9. The silver halide color photographic material as claimed in claim 1, wherein at least one layer of said at least one red-sensitive silver halide emulsion layer contains at least one of the cyan couplers represented by the formula (1) and the lowest sensitivity emulsion layer of said at least one red-sensitive silver halide emulsion layer or a layer directly adjacent thereto contains at least one of the compounds represented by the formula (2).

10. The silver halide color photographic material as claimed in claim 8, wherein the lowest sensitivity emulsion layer of said at least one red-sensitive silver halide emulsion layer or a layer directly adjacent thereto contains at least one of the couplers represented by the formula (C-1) and the amount of the couplers represented by the formula (C-1) to be added is from 1 to 3 mol per mol of the cyan couplers represented by the formula (1) incorporated in the lowest sensitivity emulsion layer.

11. The silver halide color photographic material as claimed in claim 9, wherein the lowest sensitivity emulsion layer of said at least one red-sensitive silver halide emulsion layer or a layer directly adjacent thereto contains at least one of the compounds represented by the formula (2) and the amount of the compounds represented by the formula (2) to be added is from 1 to 3 mol per mol of the cyan couplers represented by the formula (1) incorporated in the lowest sensitivity emulsion layer.

12. The silver halide color photographic material as claimed in claim 10, wherein the cyan couplers represented by the formula (1) are cyan couplers represented by the following formula (3):

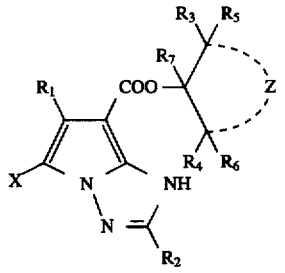

(3)

wherein $R_1$ represents a cyano group, a ring formed by Z is a cyclohexane ring, and $R_2$, $R_3$, $R_4$, $R_5$, $R_6$, $R_7$ and X each has the same meaning as in formula (1).

13. The silver halide color photographic material as claimed in claim 11, wherein the cyan couplers represented by the formula (1) are cyan couplers represented by the following formula (3):

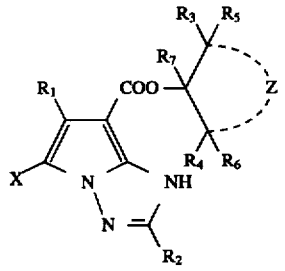

(3)

wherein $R_1$ represents a cyano group, a ring formed by Z is a cyclohexane ring, and $R_2$, $R_3$, $R_4$, $R_5$, $R_6$, $R_7$ and X each has the same meaning as in formula (1).

14. The silver halide color photographic material as claimed in claim 12, wherein $R_2$ represents an aryl group having substituents and X represents a group selected from the group consisting of a hydrogen atom, a halogen atom, an aryloxy group and a carbamoyloxy group.

15. The silver halide color photographic material as claimed in claim 13, wherein $R_2$ represents an aryl group having substituents and X represents a group selected from the group consisting of a hydrogen atom, a halogen atom, an aryloxy group and a carbamoyloxy group.

16. The silver halide color photographic material as claimed in claim 3, wherein the cyan couplers represented by the formula (1) are cyan couplers represented by the following formula (3):

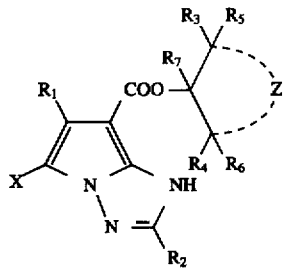

(3)

wherein $R_1$ represents a cyano group, a ring formed by Z is a cyclohexane ring, and $R_2$, $R_3$, $R_4$, $R_5$, $R_6$, $R_7$ and X each has the same meaning as in formula (1).

* * * * *